US009676222B2

(12) United States Patent
Lin

(10) Patent No.: US 9,676,222 B2
(45) **Date of Patent: *Jun. 13, 2017**

(54) RING BINDER MECHANISM

(71) Applicant: World Wide Stationery Mfg. Co., Ltd., Kwai Chung, New Territory, Hong Kong (CN)

(72) Inventor: Chun H. Lin, Zhang Zhou (CN)

(73) Assignee: World Wide Stationary Mfg. Co., Ltd., Kwai Chung, New Territories (HK)

( * ) Notice: Subject to any disclaimer, the term of this patent is extended or adjusted under 35 U.S.C. 154(b) by 0 days.

This patent is subject to a terminal disclaimer.

(21) Appl. No.: 14/933,625

(22) Filed: Nov. 5, 2015

(65) Prior Publication Data

US 2016/0059614 A1 Mar. 3, 2016

Related U.S. Application Data

(63) Continuation of application No. 14/450,736, filed on Aug. 4, 2014, now Pat. No. 9,180,721, which is a (Continued)

(51) Int. Cl.
*B42F 13/26* (2006.01)
*B42F 3/04* (2006.01)

(52) U.S. Cl.
CPC ..... *B42F 13/26* (2013.01); *B42F 3/04* (2013.01)

(58) Field of Classification Search
CPC ..... B42F 13/26; B42F 3/04
See application file for complete search history.

(56) References Cited

U.S. PATENT DOCUMENTS 566,717 A 8/1896 Krah
651,254 A 6/1900 Krah
(Continued)

FOREIGN PATENT DOCUMENTS

CA 2500817 A1 9/2005
EP 1431065 A2 6/2004
(Continued)

OTHER PUBLICATIONS

Kokuyo Lock Ring Mechanism with description, two instruction sheets, and nine photographs, undated but admitted as prior art, 12 pages.

(Continued)

*Primary Examiner* — Moshe Wilensky
*Assistant Examiner* — Pradeep C Battula
(74) *Attorney, Agent, or Firm* — Senniger Powers LLP

(57) ABSTRACT

A ring mechanism has a housing and rings for holding loose-leaf pages. Pivoting hinge plates are supported in the housing. Each ring includes a pair of ring members, at least one of which is mounted on a hinge plate and movable to open and close the rings. A travel bar carries a plurality of locking elements or wedges. The travel bar is secured to the housing in a manner that limits vertical movement of the travel bar while allowing the travel bar to translate between a locked position in which opening of the rings is blocked and an open position in which the rings are open. The travel bar is biased to remain in the locked position when it is in the locked position. The travel bar is free of forces tending to move the travel bar to the locked position when the travel bar is in the open position.

20 Claims, 21 Drawing Sheets

Related U.S. Application Data continuation of application No. 12/615,469, filed on Nov. 10, 2009, now Pat. No. 8,814,458, which is a continuation of application No. 11/190,328, filed on Jul. 27, 2005, now Pat. No. 7,661,899.

(60) Provisional application No. 60/664,125, filed on Mar. 22, 2005.

(56) References Cited

U.S. PATENT DOCUMENTS 683,019 A 9/1901 Buchanan
790,382 A 5/1905 McBride
854,074 A 5/1907 Bryant
857,377 A 6/1907 Baker
974,831 A 11/1910 Scherzinger
1,011,391 A 12/1911 Sturgis
1,163,179 A 12/1915 Schade, Jr.
1,168,260 A 1/1916 Albrecht
1,398,034 A 11/1921 Mero
1,398,388 A 11/1921 Murphy
1,733,548 A 10/1929 Martin
1,733,894 A 10/1929 Martin
1,787,957 A 1/1931 Schade
1,822,669 A 9/1931 Schade
1,857,291 A 5/1932 Trussell
1,953,981 A 4/1934 Trussell
1,991,362 A 2/1935 Krag
1,996,463 A 4/1935 Dawson et al.
2,004,570 A 6/1935 Dawson
2,013,416 A 9/1935 McClure
2,024,461 A 12/1935 Lotter
2,067,846 A 1/1937 Cooper
2,075,766 A 3/1937 Rand
2,089,211 A 8/1937 Krag
2,096,944 A 10/1937 Unger et al.
2,103,307 A 12/1937 Unger
2,105,235 A 1/1938 Schade
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,062 A 4/1941 Tallmadge
2,239,121 A 4/1941 St. Louis et al.
2,251,878 A 8/1941 Hanna et al.
2,252,422 A 8/1941 Unger
2,260,929 A 10/1941 Bloore
2,288,189 A 6/1942 Guinane
2,304,716 A 12/1942 Supin
2,311,492 A 2/1943 Unger
2,322,595 A 6/1943 Schade
2,338,011 A 12/1943 Schade
2,421,799 A 6/1947 Martin
2,528,866 A 11/1950 Dawson, Jr.
2,543,866 A 3/1951 Panfil, Sr.
2,552,076 A 5/1951 Wedge
2,612,169 A 9/1952 Segal
2,789,561 A 4/1957 Bonn et al.
2,865,377 A 12/1958 Schroer et al.
2,871,711 A 2/1959 Stark
2,891,553 A 6/1959 Acton
2,894,513 A 7/1959 Gempe et al.
2,950,719 A 8/1960 Lyon
3,077,888 A 2/1963 Thieme
3,098,489 A 7/1963 Vernon
3,098,490 A 7/1963 Wance
3,101,719 A 8/1963 Vernon
3,104,667 A 9/1963 Mintz
3,149,636 A 9/1964 Rankin
3,190,293 A 6/1965 Schneider et al.
3,205,894 A 9/1965 Rankin
3,205,895 A 9/1965 Johnson
3,255,759 A 6/1966 Dennis
3,348,550 A 10/1967 Wolf et al.
3,718,402 A 2/1973 Schade
3,748,051 A 7/1973 Frank
3,884,586 A 5/1975 Michaelis et al.
3,954,343 A 5/1976 Thomsen
3,993,374 A 11/1976 Schudy et al.
4,127,340 A 11/1978 Almgren
4,130,368 A 12/1978 Jacoby et al.
4,222,679 A 9/1980 Luogameno
4,352,582 A 10/1982 Eliasson
4,486,112 A 12/1984 Cummins
4,522,526 A 6/1985 Lozfau et al.
4,566,817 A 1/1986 Barrett, Jr.
4,571,108 A 2/1986 Vogl
4,696,595 A 9/1987 Pinkney
4,798,491 A 1/1989 Lassle
4,813,803 A 3/1989 Gross
4,815,882 A 3/1989 Ohminato
4,886,390 A 12/1989 Silence et al.
4,919,557 A 4/1990 Podosek
5,067,840 A 11/1991 Cooper et al.
5,116,157 A 5/1992 Gillum et al.
5,135,323 A 8/1992 Pinheiro
5,180,247 A 1/1993 Yu
5,255,991 A 10/1993 Sparkes
5,286,128 A 2/1994 Gillum
5,332,327 A 7/1994 Gillum
5,346,325 A 9/1994 Yamanoi
5,354,142 A 10/1994 Yu
5,368,407 A 11/1994 Law
5,378,073 A 1/1995 Law
5,393,155 A 2/1995 Ng
5,393,156 A 2/1995 Mullin et al.
5,476,335 A 12/1995 Whaley
5,524,997 A 6/1996 von Rohrscheidt
5,577,852 A 11/1996 To
5,620,206 A * 4/1997 Flores ..... B42F 11/00 281/15.1
5,651,628 A 7/1997 Bankes et al.
5,660,490 A 8/1997 Warrington
5,692,847 A 12/1997 Zane et al.
5,692,848 A 12/1997 Wada
5,718,529 A 2/1998 Chan
5,782,569 A 7/1998 Mullin et al.
5,788,392 A 8/1998 Cheung
5,807,006 A 9/1998 Cheung
5,810,499 A 9/1998 Law
5,816,729 A 10/1998 Whaley
5,836,709 A 11/1998 Cheung
5,868,513 A 2/1999 Law
5,879,097 A 3/1999 Cheng
5,882,135 A 3/1999 Ko
5,895,164 A 4/1999 Wu
5,904,435 A 5/1999 Tung
5,924,811 A 7/1999 To et al.
5,957,611 A 9/1999 Whaley
5,975,785 A 11/1999 Chan
6,036,394 A 3/2000 Cheng
6,142,697 A 11/2000 Williams
6,146,042 A 11/2000 To et al.
6,155,737 A 12/2000 Whaley
6,203,229 B1 3/2001 Coerver
6,206,601 B1 3/2001 Ko
6,217,247 B1 4/2001 Ng
6,270,279 B1 8/2001 Whaley
6,276,862 B1 * 8/2001 Snyder ..... B42F 13/26 402/26
6,293,722 B1 9/2001 Holbrook et al.
6,364,558 B1 4/2002 To
6,371,678 B1 4/2002 Chizmar
6,467,984 B1 10/2002 To
6,474,897 B1 11/2002 To
6,533,486 B1 3/2003 To
6,749,357 B2 * 6/2004 Cheng ..... B42F 13/26 402/19
6,758,621 B2 7/2004 To
6,821,045 B2 11/2004 Whaley
6,840,695 B2 1/2005 Horn
6,916,134 B2 7/2005 Wong
7,223,040 B2 5/2007 Koike et al.

(56) References Cited

U.S. PATENT DOCUMENTS

| | | | | |
|---|---|---|---|---|
| 7,270,496 | B2 | 9/2007 | Morgan et al. | |
| 7,275,886 | B2 | 10/2007 | Cheng | |
| 7,296,946 | B2 | 11/2007 | Cheng et al. | |
| 7,331,732 | B2 | 2/2008 | Kaneda | |
| 7,404,685 | B2 | 7/2008 | Cheng | |
| 7,478,963 | B2 | 1/2009 | Tanaka et al. | |
| 7,491,006 | B2 | 2/2009 | Whaley | |
| 7,524,127 | B2 | 4/2009 | Petrie et al. | |
| 7,524,128 | B2 | 4/2009 | Cheng | |
| 7,530,755 | B2 | 5/2009 | Whaley | |
| 7,534,064 | B2 | 5/2009 | Cheng | |
| 7,549,817 | B2 | 6/2009 | Cheng et al. | |
| 7,661,899 | B2 * | 2/2010 | Lin | B42F 3/04 402/19 |
| 7,704,005 | B2 * | 4/2010 | Lin | B42F 3/04 402/38 |
| 7,950,867 | B2 * | 5/2011 | Lin | B42F 3/04 402/38 |
| 8,052,343 | B2 | 11/2011 | Zhang et al. | |
| 8,186,899 | B2 | 5/2012 | Ng et al. | |
| 8,814,458 | B2 * | 8/2014 | Lin | B42F 3/04 402/19 |
| 9,180,721 | B2 * | 11/2015 | Lin | B42F 3/04 |
| 2003/0044221 | A1 | 3/2003 | To et al. | |
| 2005/0201817 | A1 | 9/2005 | Cheng | |
| 2005/0201818 | A1 | 9/2005 | Cheng | |
| 2005/0207826 | A1 | 9/2005 | Cheng et al. | |
| 2005/0214064 | A1 | 9/2005 | Ng et al. | |
| 2006/0008318 | A1 | 1/2006 | Ng | |
| 2006/0056906 | A1 | 3/2006 | Horn | |
| 2006/0147254 | A1 | 7/2006 | Cheng | |
| 2006/0228164 | A1 | 10/2006 | Horn | |
| 2006/0251468 | A1 | 11/2006 | Cheng | |
| 2007/0160415 | A1 | 7/2007 | To et al. | |
| 2008/0008519 | A1 | 1/2008 | To | |
| 2008/0075526 | A1 | 3/2008 | Ng et al. | |
| 2009/0060631 | A1 | 3/2009 | To et al. | |
| 2009/0110469 | A1 | 4/2009 | To et al. | |
| 2011/0170942 | A1 | 7/2011 | Huang et al. | |

FOREIGN PATENT DOCUMENTS

| | | | |
|---|---|---|---|
| FR | 1336765 | A | 9/1963 |
| FR | 1346864 | A | 12/1963 |
| FR | 2221924 | | 10/1974 |
| FR | 2238332 | A5 | 2/1975 |
| GB | 868724 | | 5/1961 |
| GB | 906279 | | 9/1962 |
| GB | 952536 | | 3/1964 |
| GB | 2231536 | A | 11/1990 |
| GB | 2275023 | A | 8/1994 |
| GB | 2292343 | A | 2/1996 |
| GB | 2387815 | A | 10/2003 |
| JP | 5979379 | U | 5/1984 |
| JP | 6118880 | U | 2/1986 |
| JP | 1299095 | A | 12/1989 |
| JP | 2034289 | U | 3/1990 |
| JP | 4120085 | U | 10/1992 |
| JP | 10217662 | A | 8/1998 |
| JP | 2004098417 | A | 4/2004 |
| WO | 2013026351 | A1 | 2/2013 |

OTHER PUBLICATIONS

Office action dated Aug. 28, 2009 in related U.S. Appl. No. 11/675,493, 15 pages.
Office action dated Feb. 2, 2009 in related U.S. Appl. No. 11/562,261, 10 pages.
Response dated Apr. 14, 2009 to Office Action dated Feb. 2, 2009 in related U.S. Appl. No. 11/562,261, 11 pages.
Office action dated Jul. 1, 2009 in related U.S. Appl. No. 11/562,261, 8 pages.
Response dated Sep. 8, 2009 to Office Action dated Jul. 1, 2009 in related U.S. Appl. No. 11/562,261, 5 pages.
Advisory Action dated Sep. 22, 2009 in related U.S. Appl. No. 11/562,261, 4 pages.
Response dated Nov. 2, 2009 to Advisory Action dated Sep. 22, 2009 in related U.S. Appl. No. 11/562,261, 9 pages.
European Search Report dated Aug. 29, 2006 in related European Patent Application 05 11 0903.1, 4 pages.
Office action dated Nov. 2, 2007 in related U.S. Appl. No. 11/190,328, 10 pages.
Response dated Feb. 29, 2008 to Office Action issued Nov. 2, 2007 in related U.S. Appl. No. 11/190,328, 18 pages.
Office action dated Jun. 3, 2008 in related U.S. Appl. No. 11/190,328, 16 pages.
Response dated Sep. 2, 2008 to Office Action issued Jun. 3, 2008 in related U.S. Appl. No. 11/190,328, 25 pages.
Office action dated Dec. 4, 2008 in related U.S. Appl. No. 11/190,328, 11 pages.
Response dated Apr. 3, 2009 to Office Action dated Dec. 4, 2008 in related U.S. Appl. No. 11/190,328, 22 pages.
Office action dated Jul. 1, 2009 in related U.S. Appl. No. 11/190,328, 12 pages.
Response dated Sep. 8, 2009 to Office Action dated Jul. 1, 2009 in related U.S. Appl. No. 11/190,328, 15 pages.
Office action dated Aug. 19, 2010 in related U.S. Appl. No. 12/719,461, 9 pages.
Appeal Brief dated Jan. 19, 2011 in response to Office action dated Aug. 19, 2010 in related U.S. Appl. No. 12/719,461, 15 pages.
Office action dated Feb. 2, 2010 in related U.S. Appl. No. 12/615,469, 10 pages.
Appeal Brief dated Aug. 3, 2010 in response to Office Action dated Feb. 2, 2010 in related U.S. Appl. No. 12/615,469, 26 pages.
Decision on Appeal dated May 16, 2013 in related U.S. Appl. No. 12/615,469, 12 pages.
Amendment After Decision on Appeal dated Jun. 24, 2013 in response to Decision on Appeal dated May 16, 2013 in related U.S. Appl. No. 12/615,469, 9 pages.
Office action dated Jul. 9, 2013 in related U.S. Appl. No. 12/615,469, 9 pages.
Response dated Jan. 9, 2014 to Office Action dated Jul. 9, 2013 in related U.S. Appl. No. 12/615,469, 3 pages.
Response dated Nov. 30, 2009 to Office Action dated Aug. 28, 2009 in related U.S. Appl. No. 11/675,493, 14 pages.
Office Action dated Jan. 16, 2015 in related U.S. Appl. No. 14/450,736, 9 pages.
Office Action dated Mar. 23, 2015 in related U.S. Appl. No. 14/450,736, 9 pages.
Response dated May 26, 2015 to Office Action dated Mar. 23, 2015 in related U.S. Appl. No. 14/450,736, 6 pages.

* cited by examiner

RING BINDER MECHANISM

CROSS REFERENCE TO RELATED APPLICATION

This application is a continuation application of U.S. application Ser. No. 14/450,736, filed Aug. 4, 2014, entitled LEVER FOR A RING BINDER MECHANISM, which will be issued as U.S. Pat. No. 9,180,721 on Nov. 10, 2015, and which is a continuation of U.S. application Ser. No. 12/615,469, entitled LEVER FOR A RING BINDER MECHANISM, filed Nov. 10, 2009, now U.S. Pat. No. 8,814,458, which is a continuation application of U.S. application Ser. No. 11/190,328, filed Jul. 27, 2005, entitled LEVER FOR A RING BINDER MECHANISM, now U.S. Pat. No. 7,661,899, and which claims the benefit of U.S. Provisional Application No. 60/664,125, filed Mar. 22, 2005, entitled RING BINDER MECHANISM WITH SPRING LOCK ACTUATOR, the entire contents of which are all hereby incorporated by reference.

BACKGROUND OF THE INVENTION

This invention relates to a ring binder mechanism for retaining loose-leaf pages, and in particular to an improved ring binder mechanism for opening and closing ring members and for locking closed ring members together.

A ring binder mechanism retains loose-leaf pages, such as hole-punched pages, in a file or notebook. It has ring members for retaining the pages. The ring members may be selectively opened to add or remove pages or closed to retain pages while allowing the pages to be moved along the ring members. The ring members mount on two adjacent hinge plates that join together about a pivot axis. An elongate housing loosely supports the hinge plates within the housing and holds the hinge plates together so they may pivot relative to the housing.

The undeformed housing is slightly narrower than the joined hinge plates when the hinge plates are in a coplanar position (180E). So as the hinge plates pivot through this position, they deform the resilient housing and cause a spring force in the housing that urges the hinge plates to pivot away from the coplanar position, either opening or closing the ring members. Thus, when the ring members are closed the spring force resists hinge plate movement and clamps the ring members together. Similarly, when the ring members are open, the spring force holds them apart. An operator may typically overcome this force by manually pulling the ring members apart or pushing them together. Levers may also be provided on one or both ends of the housing for moving the ring members between the open and closed positions. But a drawback to these known ring binder mechanisms is that when the ring members are closed, they do not positively lock together. So if the mechanism is accidentally dropped, the ring members may unintentionally open.

Some ring binder mechanisms have been modified to include locking structure to block the hinge plates from pivoting when the ring members are closed. The blocking structure positively locks the closed ring members together, preventing them from unintentionally opening if the ring mechanism is accidentally dropped. The blocking structure also allows the housing spring force to be reduced because the strong spring force is not required to clamp the closed ring members together. Thus, less operator force is required to open and close the ring members of these mechanisms than in traditional ring mechanisms.

Some of these ring mechanisms incorporate the locking structure onto a control slide connected to the lever. The lever moves the control slide (and its locking structure) to either block the pivoting movement of the hinge plates or allow it. But a drawback to these mechanisms is that an operator must positively move the lever after closing the ring members to position the locking structure to block the hinge plates and lock the ring members closed. Failure to do this could allow the hinge plates to inadvertently pivot and open the ring members, especially if the mechanisms are accidentally dropped.

Some locking ring binder mechanisms use springs to move the locking structure into position blocking the hinge plates when the ring members close. Examples are shown in co-owned U.S. patent application Ser. No. 10/870,801 (Cheng et al.), Ser. No. 10/905,606 (Cheng), and Ser. No. 11/027,550 (Cheng). These mechanisms employ separate springs to help lock the mechanisms.

Accordingly, there is a need for a simple ring binder mechanism that readily locks ring members together when the mechanism is closed without requiring additional spring components to do so.

SUMMARY OF THE INVENTION

A ring mechanism for holding loose-leaf pages generally comprises a housing and rings for holding the loose-leaf pages. Each ring includes a first ring member and a second ring member. At least one of the ring members is movable relative to the housing and the other ring member between a closed position and an open position. In the closed position, the two ring members form a substantially continuous, closed loop for allowing loose-leaf pages retained by the rings to be moved along the rings from one ring member to the other. In the open position, the two ring members form a discontinuous, open loop for adding or removing loose-leaf pages from the rings. An actuation system of the mechanism comprises first and second hinge plates supported by the housing for pivoting motion relative to the housing, and an actuator mounted on the housing for movement relative to the housing to cause the pivoting motion of the hinge plates. The at least one ring member is mounted on the first hinge plate. A travel bar is moveable by the actuator between a locked position and an unlocked position. The actuation system is adapted to move the travel bar from the locked position toward the unlocked position in response to movement of the actuator. The actuation system is further adapted to deform while moving the travel bar from the locked position toward the unlocked position to delay the pivoting motion of the hinge plates from the movement of the actuator.

Other features of the invention will be in part apparent and in part pointed out hereinafter.

BRIEF DESCRIPTION OF THE DRAWINGS

Corresponding reference numbers indicate corresponding parts throughout the views of the drawings.

DETAILED DESCRIPTION

Figure 1:
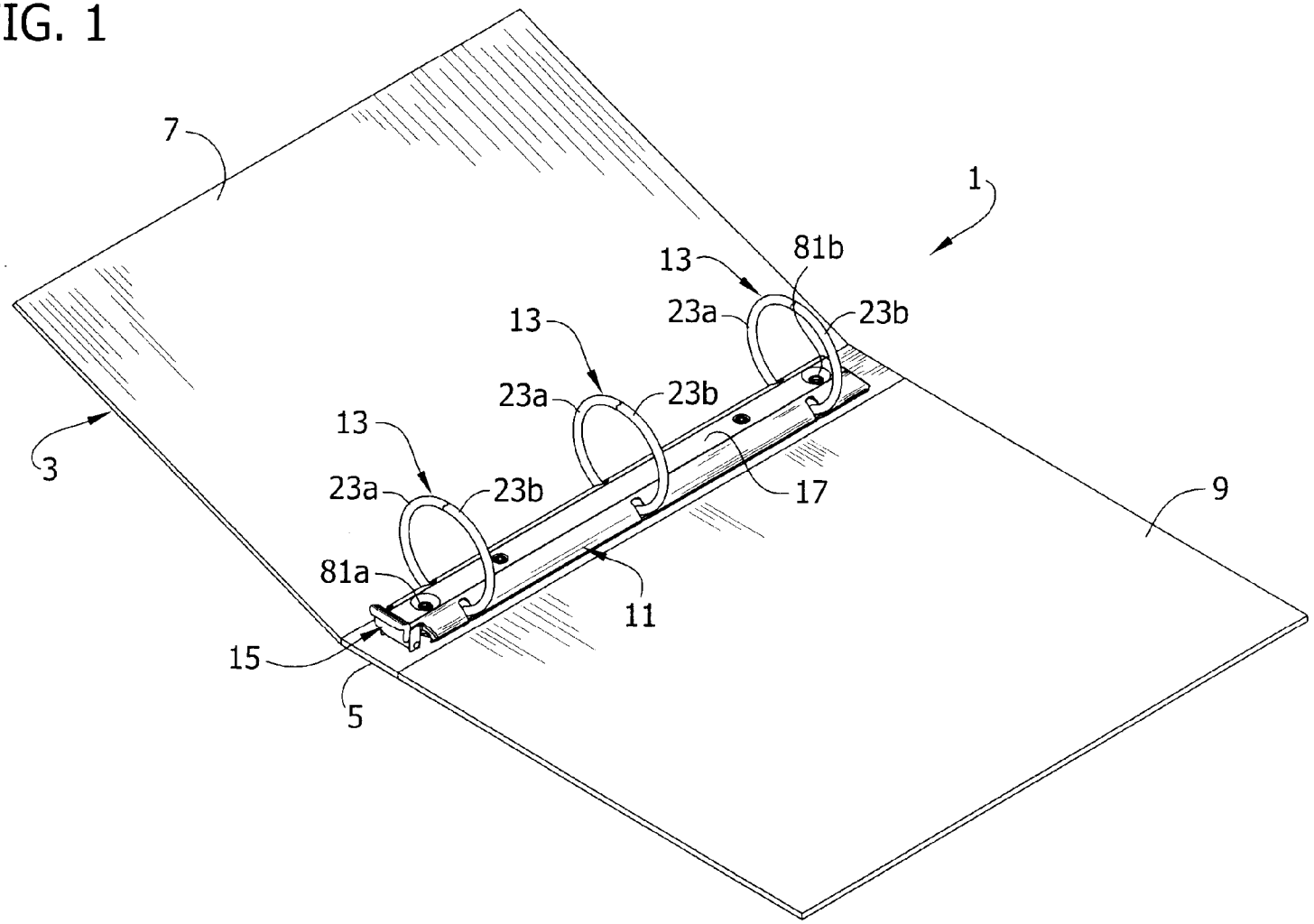
FIG. 1 is a perspective of a notebook incorporating a ring binder mechanism according to a first embodiment of the invention.

Referring to the drawings, FIGS. 1-13 show a ring binder mechanism according to a first embodiment generally at 1. In FIG. 1, the mechanism 1 is shown mounted on a notebook designated generally at 3. Specifically, the mechanism 1 is shown mounted on a spine 5 of the notebook 3 between a front cover 7 and a back cover 9 hingedly attached to the spine 3. The front and back covers 7, 9 move to selectively cover or expose loose-leaf pages (not shown) retained by the mechanism 1 in the notebook 3. Ring binder mechanisms mounted on surfaces other than a notebook, for example, a file, do not depart from the scope of this invention.

Figure 2:
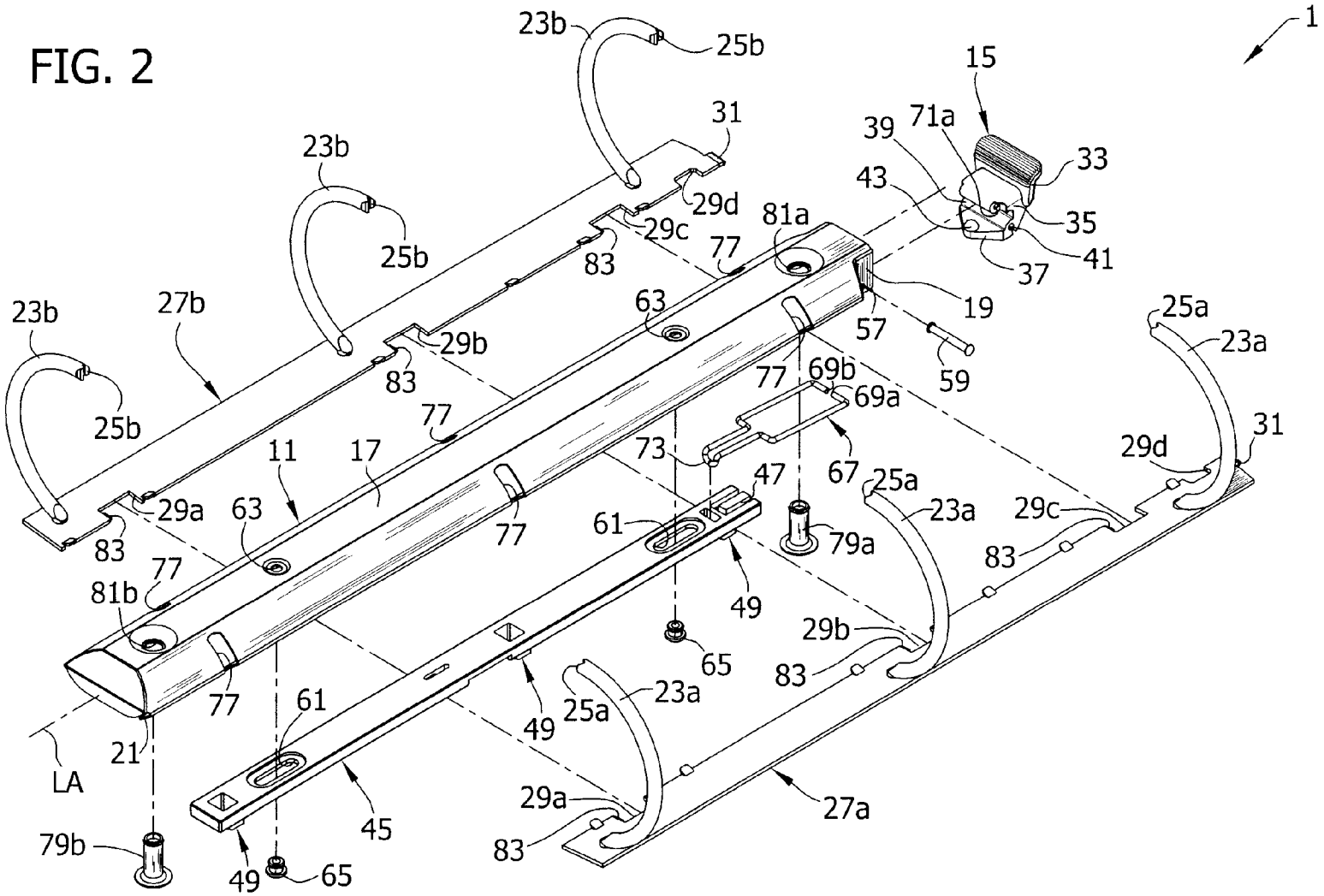
FIG. 2 is an exploded perspective of the ring mechanism.

As shown in FIG. 1, a housing, designated generally at 11, supports three rings (each designated generally at 13) and a lever (broadly, "actuator," and designated generally at 15). The rings 13 retain loose-leaf pages on the ring mechanism 1 in the notebook 3 while the lever 15 operates to open and close the rings so that pages may be added or removed. Referring now also to FIG. 2, the housing 11 is shaped as an elongated rectangle with a uniform, roughly arch-shaped cross section, having at its center a generally flat plateau 17. A first longitudinal end of the housing 11 (to the left in FIG. 1 and to the right in FIG. 2) is generally open while a second, opposite longitudinal end is generally closed. A pair of mounting arms, each designated 19 (FIGS. 2 and 4), extend downward from the housing plateau 17 at the open end, while bent under rims, each designated at 21 (FIGS. 2 and 5), extend lengthwise along longitudinal edges of the housing 11 from the first longitudinal end of the housing to the second longitudinal end. Mechanisms having housings of other shapes, including irregular shapes, or housings that are integral with a file or notebook do not depart from the scope of this invention.

Figure 4:
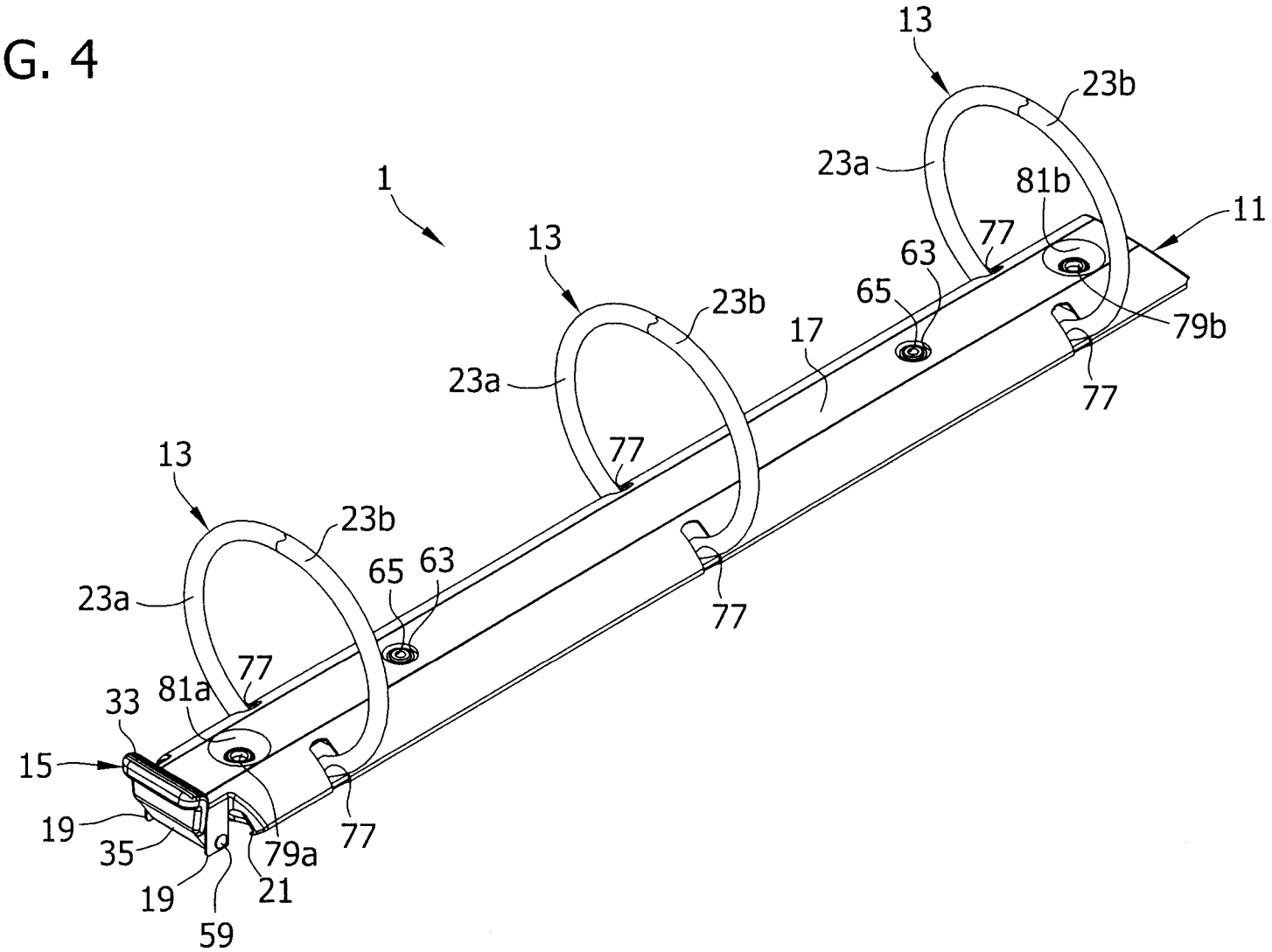
FIG. 4 is a top side perspective of the ring mechanism at a closed and locked position with the lever in a first relaxed position.
Figure 5:
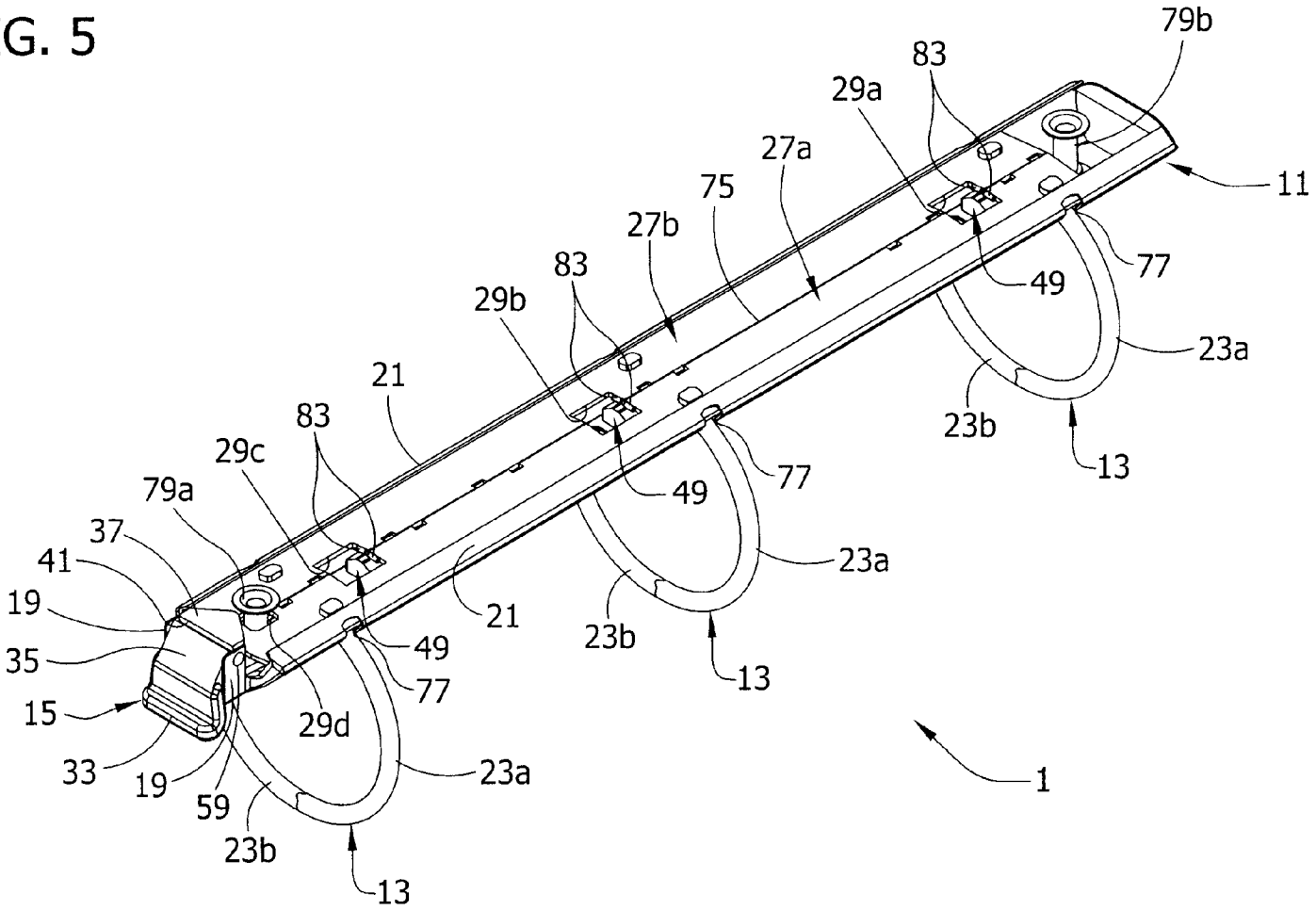
FIG. 5 is a bottom side perspective thereof.

The three rings 13 of the ring binder mechanism 1 are substantially similar and are each generally circular in shape (FIGS. 1, 4, and 5). As shown in FIGS. 1 and 2, the rings 13 each include two generally semi-circular ring members 23*a*, 23*b* formed from a conventional, cylindrical rod of a suitable material (e.g., steel). The ring members 23*a*, 23*b* include free ends 25*a*, 25*b*, respectively, formed to secure the ring members against transverse misalignment (relative to longitudinal axes of the ring members) when they are together (e.g., FIGS. 1, 4, and 5). The rings 13 could be D-shaped as is known in the art within the scope of this invention. Ring binder mechanisms with ring members formed of different material or having different cross-sectional shapes, for example, oval shapes, do not depart from the scope of this invention.

As also shown in FIG. 2, the ring mechanism 1 includes two substantially identical hinge plates, designated generally at 27*a*, 27*b*, supporting the ring members 23*a*, 23*b*, respectively. The hinge plates 27*a*, 27*b* are each generally elongate, flat, and rectangular in shape and are each somewhat shorter in length than the housing 11. Four corresponding cutouts 29*a-d* are formed in each of the hinge plates 27*a*, 27*b* along an inner edge margin of the plate. A bent down finger 31 extends longitudinally away from a first end of each of the hinge plates 27*a*, 27*b* (to the right in FIG. 2). The fingers 31 are each narrower in width than the respective hinge plates 27*a*, 27*b* and are positioned with their inner longitudinal edges generally aligned with the inner longitudinal edges of the plates. The purpose of the cutouts 29*a-d* and fingers 31 will be described hereinafter.

Figure 3:
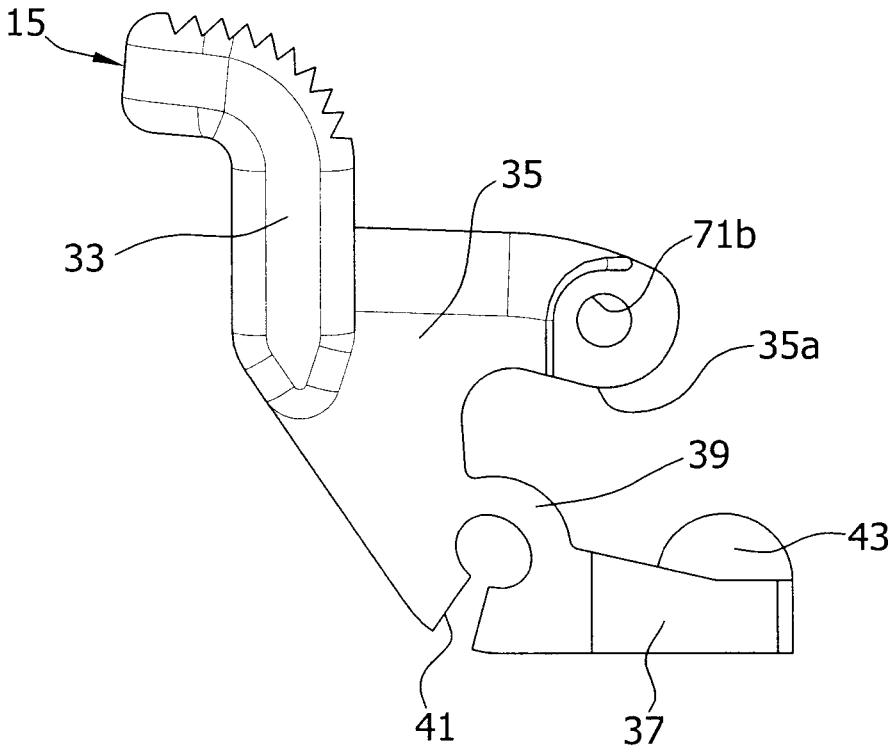
FIG. 3 is an enlarged side view of a lever of the mechanism.

Referring to FIGS. 2 and 3, the lever 15 includes a grip 33 with an inverted "L" shape, a body 35 ("first portion") attached to the grip, and a tongue 37 ("second portion") attached to the body. The grip 33 is somewhat broader than both the body 35 and the tongue 37 (FIG. 2) and facilitates grasping the lever 15 and applying force to move the lever. In the illustrated ring mechanism 1, the body 35 is formed as one piece with the grip 33 for substantially conjoint movement with the grip. The body 35 may be formed separate from the grip 33 and attached thereto without departing from the scope of the invention.

As shown in FIG. 3, the tongue 37 of the lever 15 is attached to the body 35 by a flexible bridge 39 (or "living hinge") formed as one piece with the body and tongue. A mechanism having a lever in which a bridge is formed separate from a body and/or tongue for connecting the body and tongue does not depart from the scope of the invention. The bridge 39 is generally arch-shaped and defines an open channel 41 between the tongue 37 and body 35. The tongue 37 extends away from the body 35 at the bridge 39 and channel 41 in general parallel alignment with an upper lip 35*a* of the body and defines a C-shaped space between the body and tongue (above the bridge). It is envisioned that the lever 15 is formed from a resilient plastic material by, for example, a mold process. But the lever 15 may be formed from other materials or other processes within the scope of this invention. A ring mechanism having a lever shaped differently than illustrated and described herein does not depart from the scope of the invention.

As also shown in FIG. 3, the lever 15 includes a pivot bulb 43 located toward an end of the tongue 37 opposite the bridge 39. The bulb 43 may be separate from the tongue 37 and releasably attached thereto by a tab (not shown) inserted through an opening (not shown) in the tongue. As another example, the bulb 43 may be formed as one piece with the tongue 37 within the scope of this invention.

Referring again to FIG. 2, the ring mechanism 1 includes an elongated, generally flat, rectangular travel bar designated generally at 45. The travel bar includes a rectangular mounting groove 47 at a first end (to the right in FIG. 2) and three block-shaped locking elements (each designated generally at 49) along a bottom surface. The locking elements 49 are spaced apart longitudinally along the travel bar 45 with one locking element adjacent each longitudinal end of the travel bar, and one located toward a center of the travel bar. The travel bar 45 may have other shapes or greater or fewer than three locking elements 49 within the scope of this invention. The travel bar 45 could be formed without locking elements and instead carry wedges, for example, that move the hinge plates 27*a*, 27*b*.

The locking elements 49 of the illustrated travel bar 45 are each substantially similar in shape. As best shown in FIGS. 7, 10, 12, and 13, each locking element 49 includes a narrow, flat bottom 53 and generally vertical sides 55*a-d*. The side 55*a* facing away from the lever 15 is angled and the lateral sides 55*b*, 55*d* are converging toward their bottoms to form the narrow, flat bottom 53. In the illustrated embodiment, the locking elements 49 are formed as one piece of material with the travel bar 45 by, for example, a mold process. But the locking elements 49 may be formed separately from the travel bar 45 and attached thereto without departing from the scope of the invention. Additionally, locking elements with different shapes, for example, block shapes (e.g., no angled sides or converging sides), are within the scope of this invention.

Figure 6:
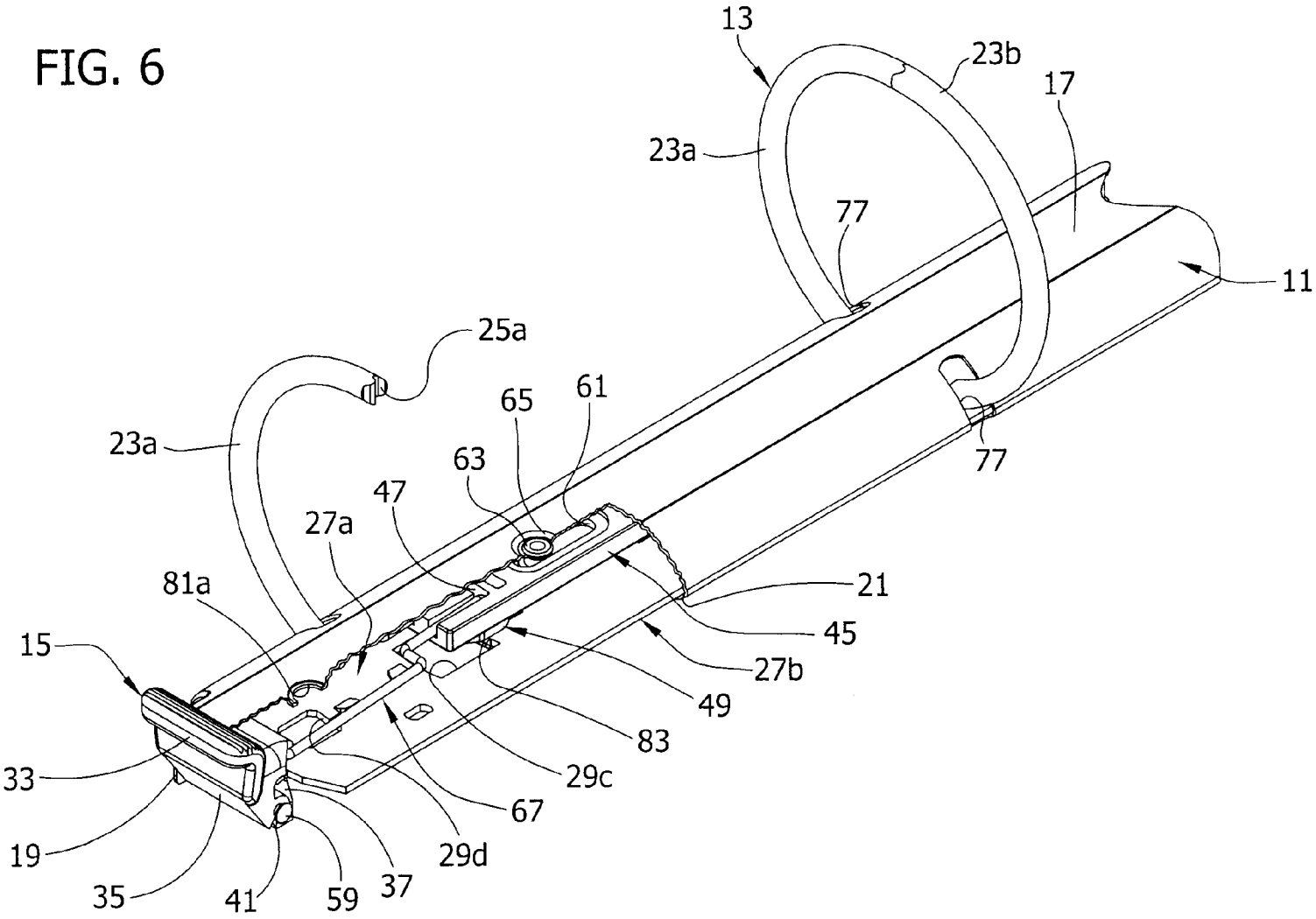
FIG. 6 is an enlarged fragmentary perspective of the ring mechanism with a portion of a housing broken away and with a ring member removed to show internal construction.

The ring binder mechanism 1 in assembled form will now be described with reference to FIGS. 4-7 in which the mechanism is illustrated with the ring members 23*a*, 23*b* in the closed position and the lever 15 in an upright position. The lever 15 pivotally mounts on the first, open end of the housing 11 at the mounting arms 19 of the housing (FIGS. 4-6). A mounting opening 57 (FIG. 2) in each mounting arm 19 aligns with the channel 41 of the lever 15. A hinge pin 59 passes through the aligned openings 57 and channel 41 to pivotally mount the lever on the housing 11. It is envisioned that the mounting arms 19 are one piece with the housing 11, but they may be formed separately from the housing and attached thereto without departing from the scope of the invention.

As shown in FIG. 6, the travel bar 45 is disposed within the housing 11 behind the housing's plateau 17. It extends lengthwise of the housing 11, in generally parallel orientation with a longitudinal axis LA (FIG. 2) of the housing, with the locking elements 49 extending away from the housing. Two elongate openings, each designated 61 (only one is shown in FIG. 6; see also, FIG. 2), through the travel bar 45 align with two rivet openings, each designated 63 (only one is shown in FIG. 6; see also, FIG. 2) of the housing plateau 17. Grooved rivets, each designated 65 (only one is shown in FIG. 6; see also, FIG. 2), secure to the housing 11 at the rivet openings 63 and extend through the respective elongate openings 61 of the travel bar 45 to vertically support the travel bar within the housing. The travel bar 45 fits within the grooves of the rivets 65, allowing it to slide in translation lengthwise of the housing 11 relative to the rivets.

Figure 7:
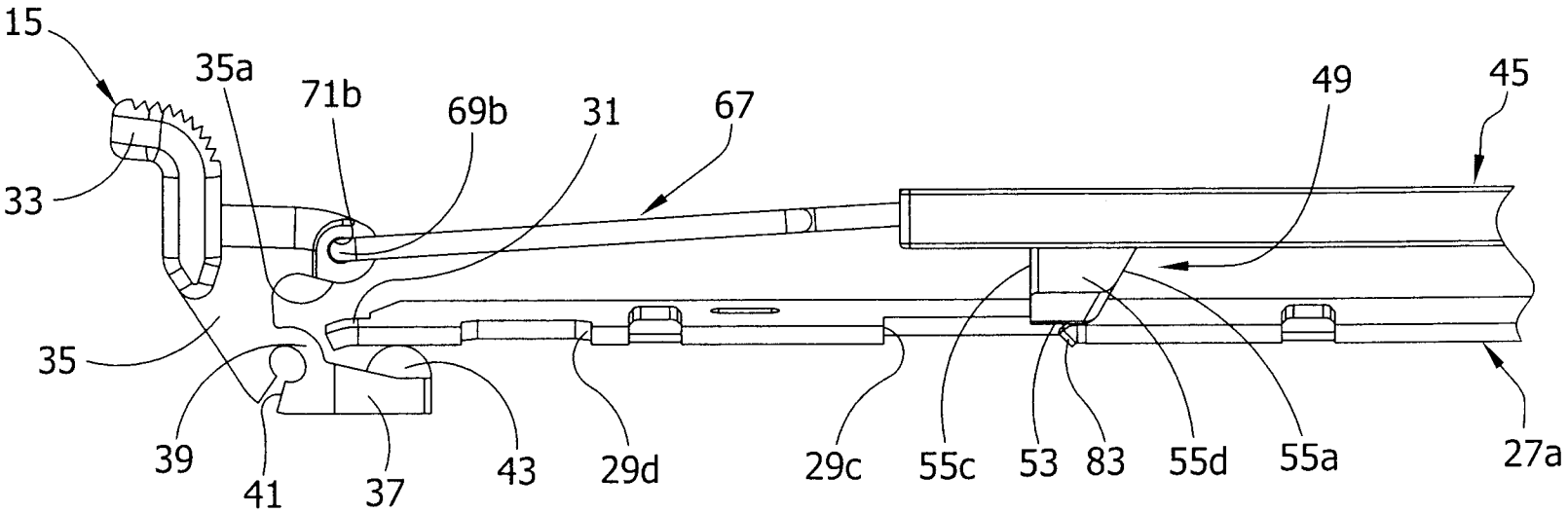
FIG. 7 is a side view thereof with the housing and ring members removed.

Referring to FIGS. 6 and 7, the travel bar 45 is operatively connected to the lever 15 by an intermediate connector, designated generally at 67. In the illustrated embodiment, the intermediate connector 67 is a wire bent into an elongate, roughly rectangular form (FIG. 2). The intermediate connector 67 may have other shapes or be formed from other material within the scope of this invention. A first end of the intermediate connector 67 is open and includes two free ends 69*a*, 69*b* (FIG. 2) that fit within openings 71*a*, 71*b* (FIG. 3, only opening 71*b* is visible) in the body 35 of the lever 15 to form a pivoting connection. A second, closed end of the intermediate connector 67 is narrowed and includes a bent end 73 (FIG. 2) that fits within the mounting groove 47 of the travel bar 45. The bent end 73 secures the intermediate connector 67 to the travel bar 45 at mounting groove 47 to either push against the travel bar or pull on the travel bar. The bent end 73 allows the intermediate connector 67 to pivot relative to the travel bar 45 to accommodate small vertical movements of the intermediate connector that occur when the lever 15 pivots. A ring binder mechanism lacking an intermediate connector (e.g., in which a travel bar is pivotally connected directly to a lever) does not depart from the scope of this invention.

As shown in FIGS. 5 and 6, the hinge plates 27*a*, 27*b* are interconnected in parallel arrangement along their inner longitudinal edge margins, forming a central hinge 75 having a pivot axis. This is done in a conventional manner known in the art. As will be described, the hinge plates 27*a*, 27*b* can pivot about the hinge 75 upward and downward. The four cutouts 29*a-d* in each of the two individual hinge plates 27*a*, 27*b* (FIG. 2) align to form four openings also designated 29*a-d* in the interconnected plates (FIG. 5). The housing 11 supports the interconnected hinge plates 27*a*, 27*b* within the housing below the travel bar 45. The outer longitudinal edge margins of the hinge plates 27*a*, 27*b* loosely fit behind the bent under rims 21 of the housing 11 for allowing them to move within the rims when the hinge plates pivot. As shown in FIG. 7, the fingers 31 of the hinge plates 27*a*, 27*b* (only one hinge plate 27*a* is shown) extend into the C-shaped space of the lever 15 between the tongue 37 and the upper lip 35*a* of the body 35 so that lower surfaces of the hinge plates engage the lever bulb 43.

The ring members 23*a*, 23*b* are each mounted on upper surfaces of respective ones of the hinge plates 27*a*, 27*b* in generally opposed fashion, with the free ends 25*a*, 25*b* facing (see also, FIG. 2). The ring members 23*a*, 23*b* extend through respective openings, each designated 77, along sides of the housing 11 so that the free ends 25*a*, 25*b* of the ring members can engage above the housing (e.g., FIG. 4). The ring members 23*a*, 23*b* are rigidly connected to the hinge plates 27*a*, 27*b* as is known in the art and move with the hinge plates when they pivot. Although in the illustrated ring binder mechanism 1 both ring members 23*a*, 23*b* of each ring 13 are each mounted on one of the two hinge plates 27*a*, 27*b* and move with the pivoting movement of the hinge plates, a mechanism in which each ring has one movable ring member and one fixed ring member does not depart from the scope of this invention (e.g., a mechanism in which only one of the ring members of each ring is mounted on a hinge plate with the other ring member mounted, for example, on a housing).

As shown in FIG. 5, two mounting posts 79*a*, 79*b* (see also, FIG. 2) are secured to the illustrated ring mechanism 1 to mount the mechanism on, for example, a notebook 3 (e.g., FIG. 1) in any suitable manner. The posts 79*a*, 79*b* attach to the housing 11 at mounting post openings 81*a*, 81*b* (FIG. 2) of the plateau 17 located toward the longitudinal ends of the housing. A first mounting post 79*a* (toward the left in FIG. 5) extends through the intermediate connector 67 and through mounting post opening 29*d* of the interconnected hinge plates 27*a*, 27*b*.

Figure 9:
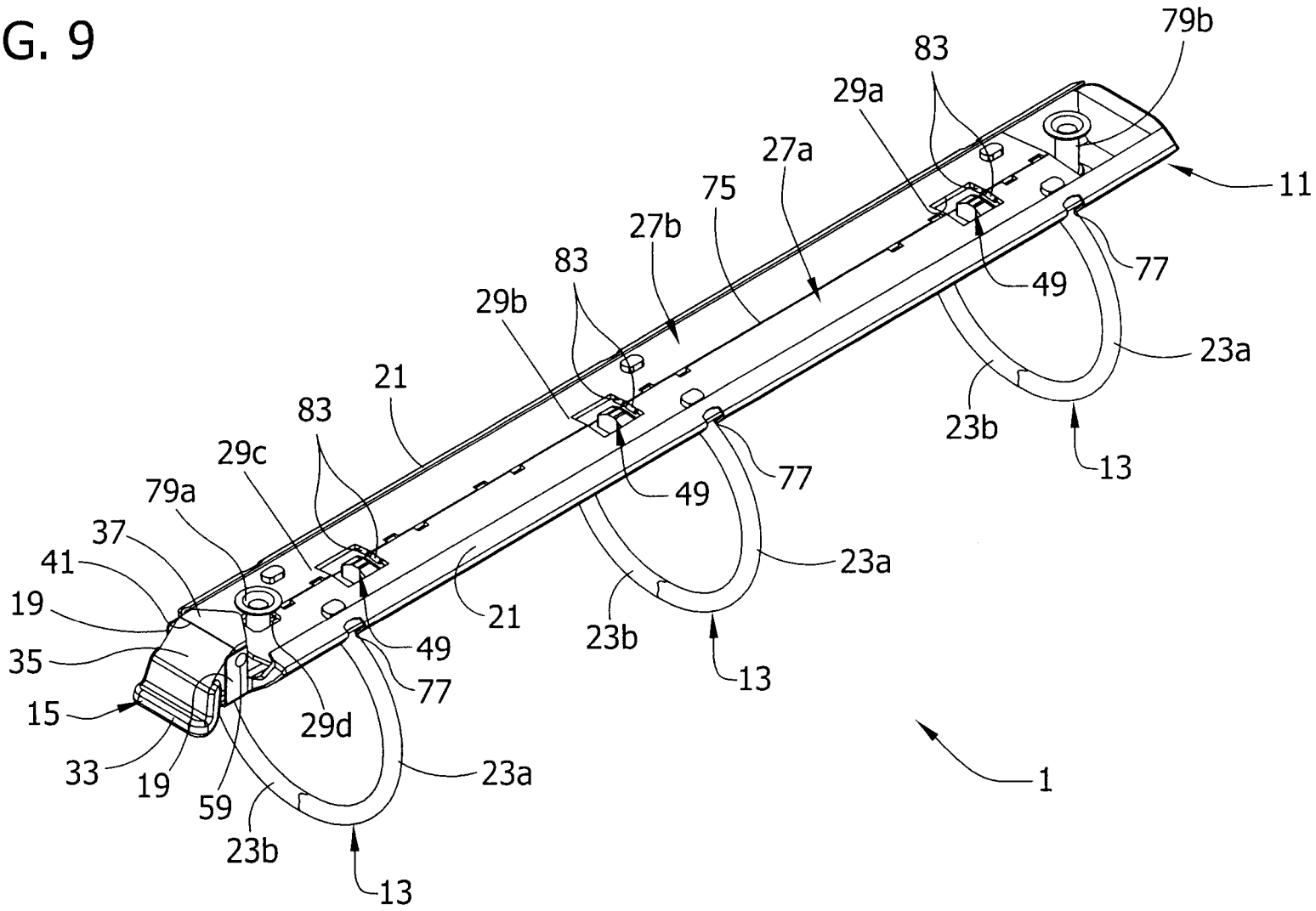
FIG. 9 is a bottom side perspective thereof.
Figure 10:
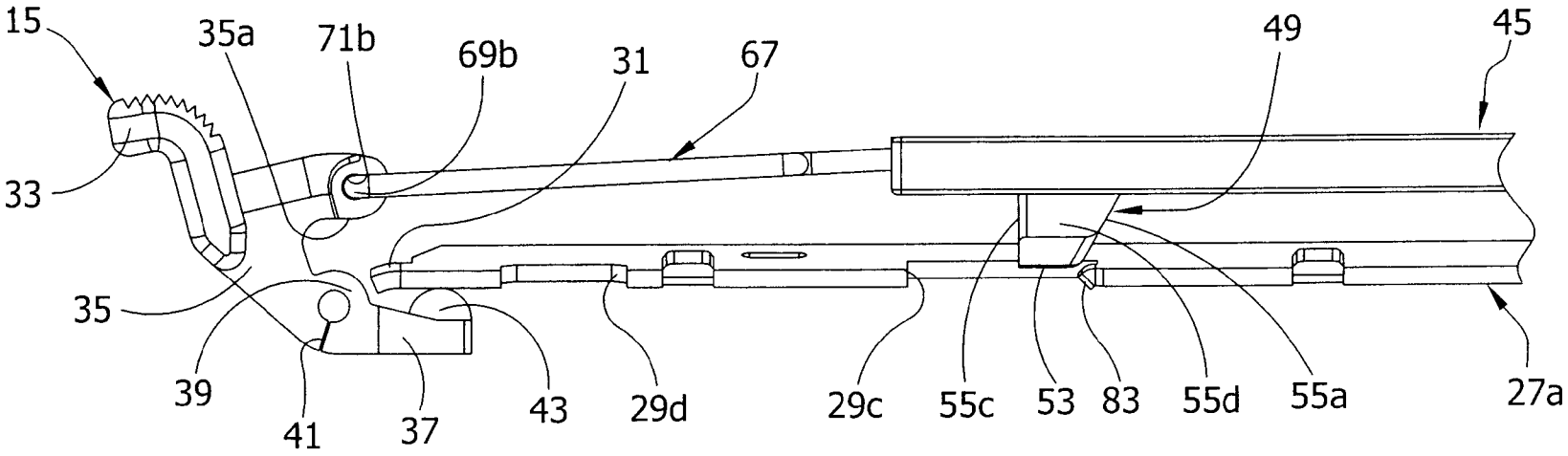
FIG. 10 is an enlarged fragmentary side view thereof with the housing and ring members removed.
Figure 11:
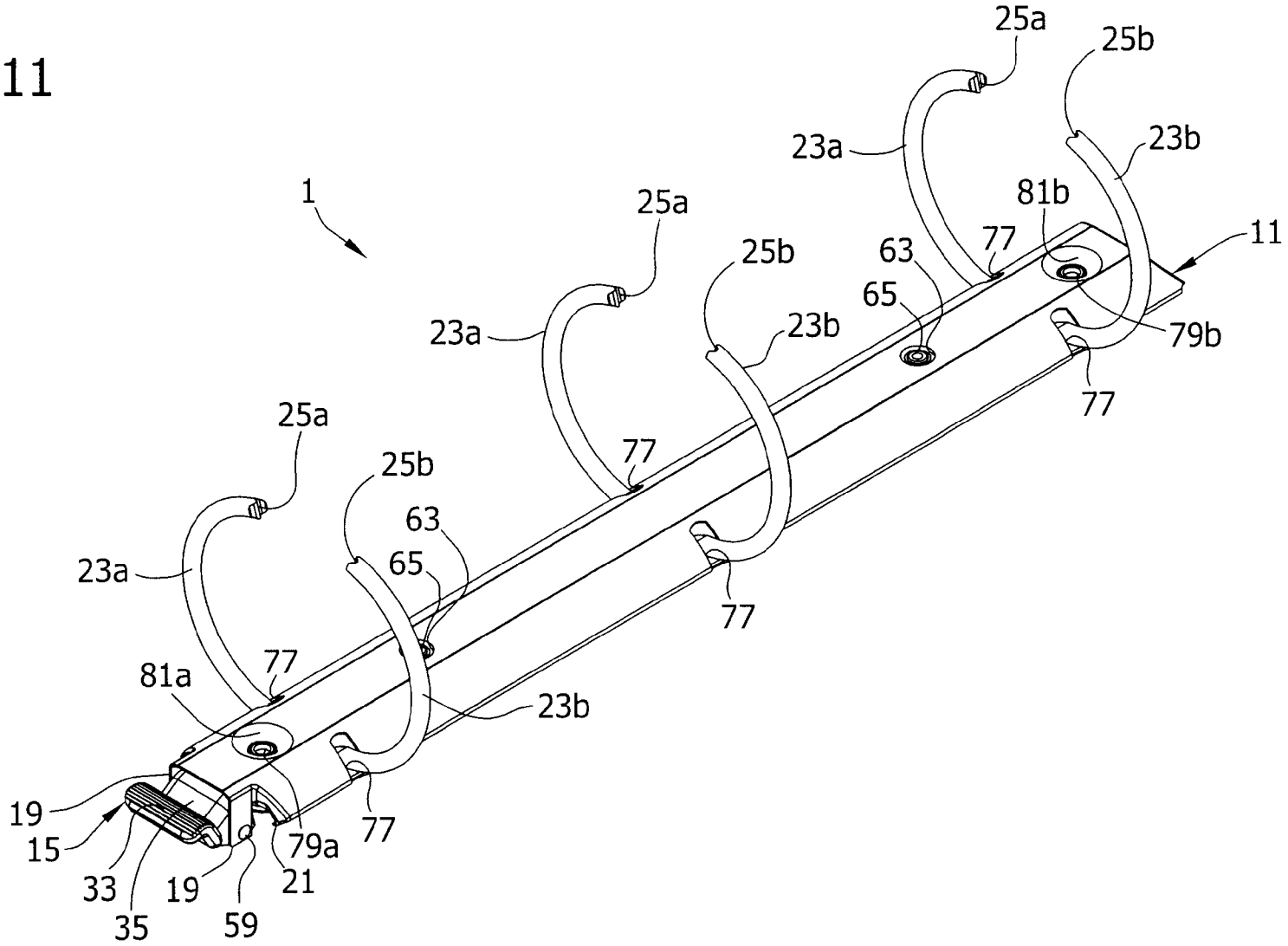
FIG. 11 is a topside perspective of the ring mechanism at an open position with the lever at a second relaxed position.
Figure 12:
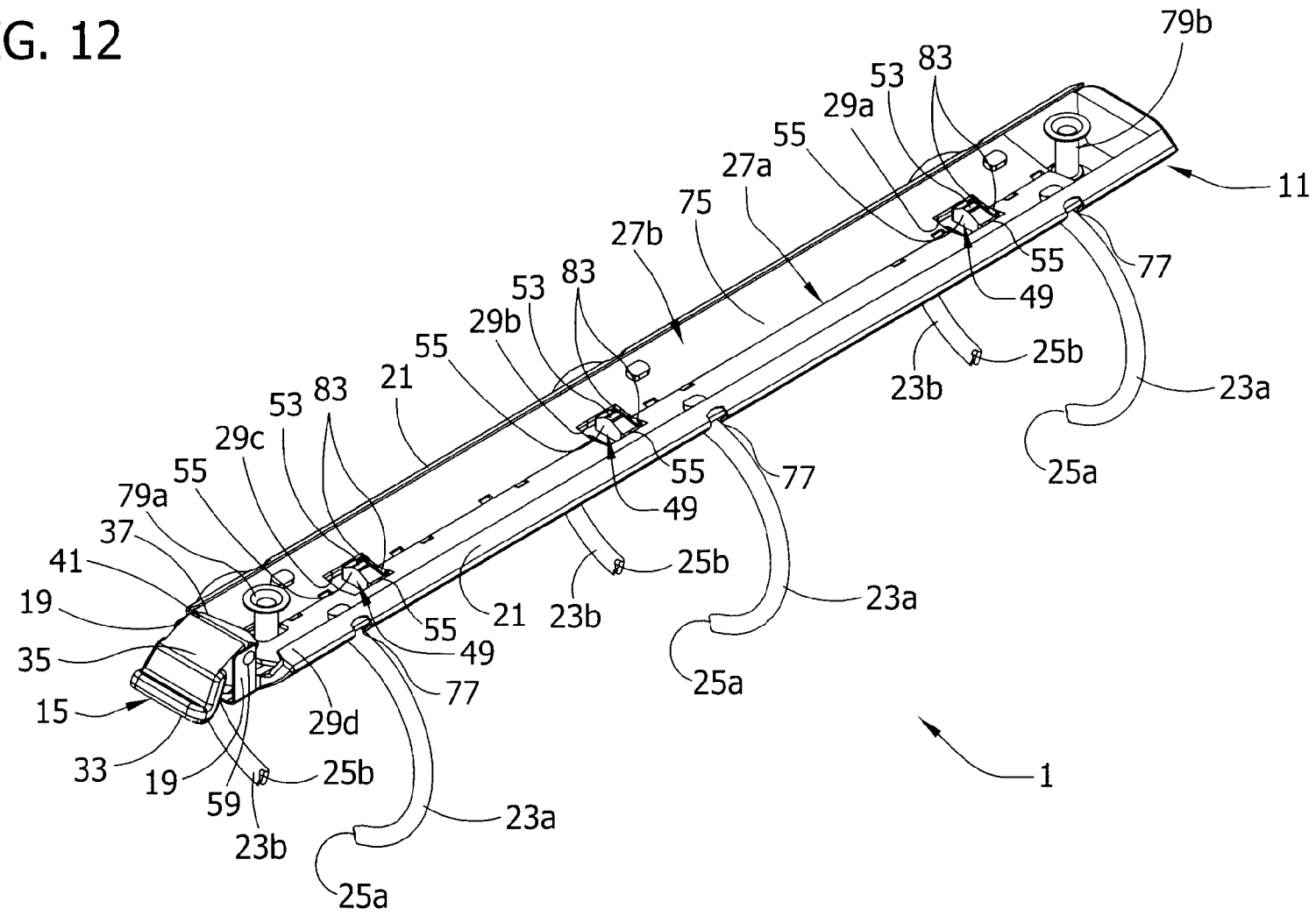
FIG. 12 is a bottom side perspective thereof.
Figure 13:
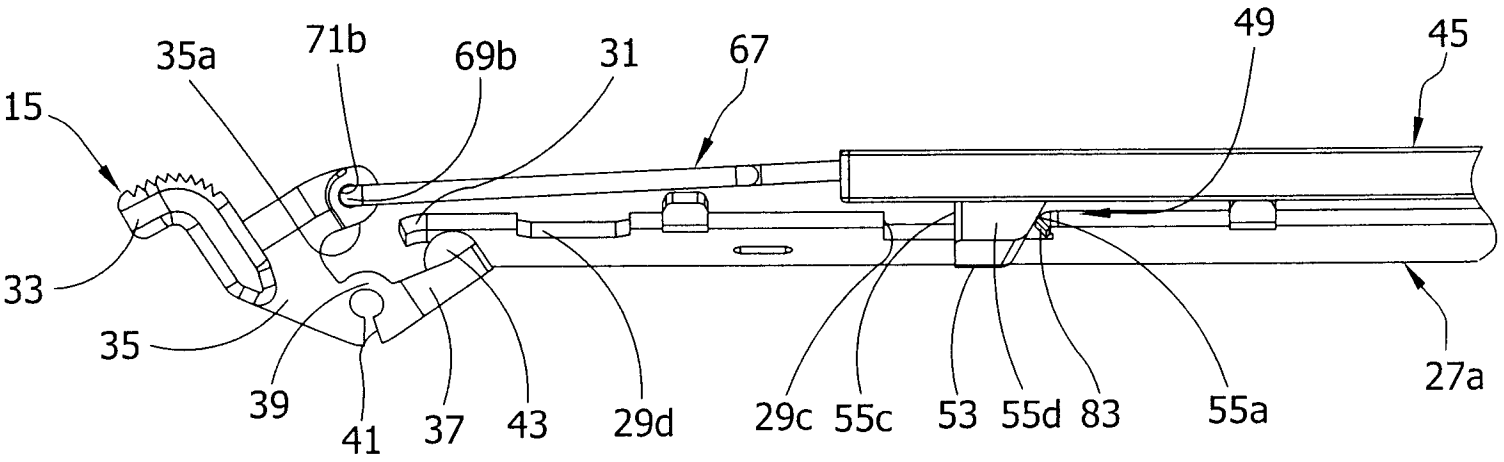
FIG. 13 is an enlarged fragmentary side view thereof with the housing and ring members removed to show internal construction.

Operation of the ring mechanism 1 will be described with reference to FIGS. 4-13. As is known, the hinge plates 27*a*, 27*b* pivot downward and upward relative to the housing 11 and move the ring members 23*a*, 23*b* mounted thereon between a closed position (FIGS. 1, 4-10) and an open position (FIGS. 11-13). The hinge plates 27*a*, 27*b* are wider than the housing 11 when in a co-planar position (180E), so as they pivot through the co-planar position, they deform the housing and create a small spring force in the housing. The housing spring force biases the hinge plates 27*a*, 27*b* to pivot away from the co-planar position, either downward or upward. The ring members 23*a*, 23*b* close when the hinge plates 27*a*, 27*b* pivot downward (i.e., the hinge 75 moves away from the housing 11 (e.g., FIG. 5)). The ring members 23*a*, 23*b* open when the hinge plates 27*a*, 27*b* pivot upward (i.e., the hinge 75 moves toward the housing 11 (e.g., FIG. 12)).

In FIGS. 4-7, the ring mechanism 1 is in a closed and locked position. The hinge plates 27*a*, 27*b* are hinged downward, away from housing 11, so that the ring members 23*a*, 23*b* of each ring 13 are together in a continuous, circular loop, capable of retaining loose-leaf pages. The lever 15 is vertical relative to the housing 11 and in a first relaxed position (the lever is shown in this position in FIG. 3 also) with the lever bulb 43 engaging the lower surfaces of the hinge plates 27*a*, 27*b*. The locking elements 49 of the travel bar 45 are above the hinge plates 27*a*, 27*b* generally aligned with the hinge 75 with their narrow, flat bottoms 53 contacting the upper surfaces of the hinge plates. As shown in FIG. 5, the locking elements 49 are adjacent respective locking element openings 29*a-c*, but are substantially out of registration with the openings. Together, the travel bar 45 (vertically supported by the grooved rivets 65) and locking elements 49 oppose any force tending to pivot the hinge plates 27*a*, 27*b* upward to open the ring members 23*a*, 23*b* (i.e., they lock the ring members closed).

Figure 8:
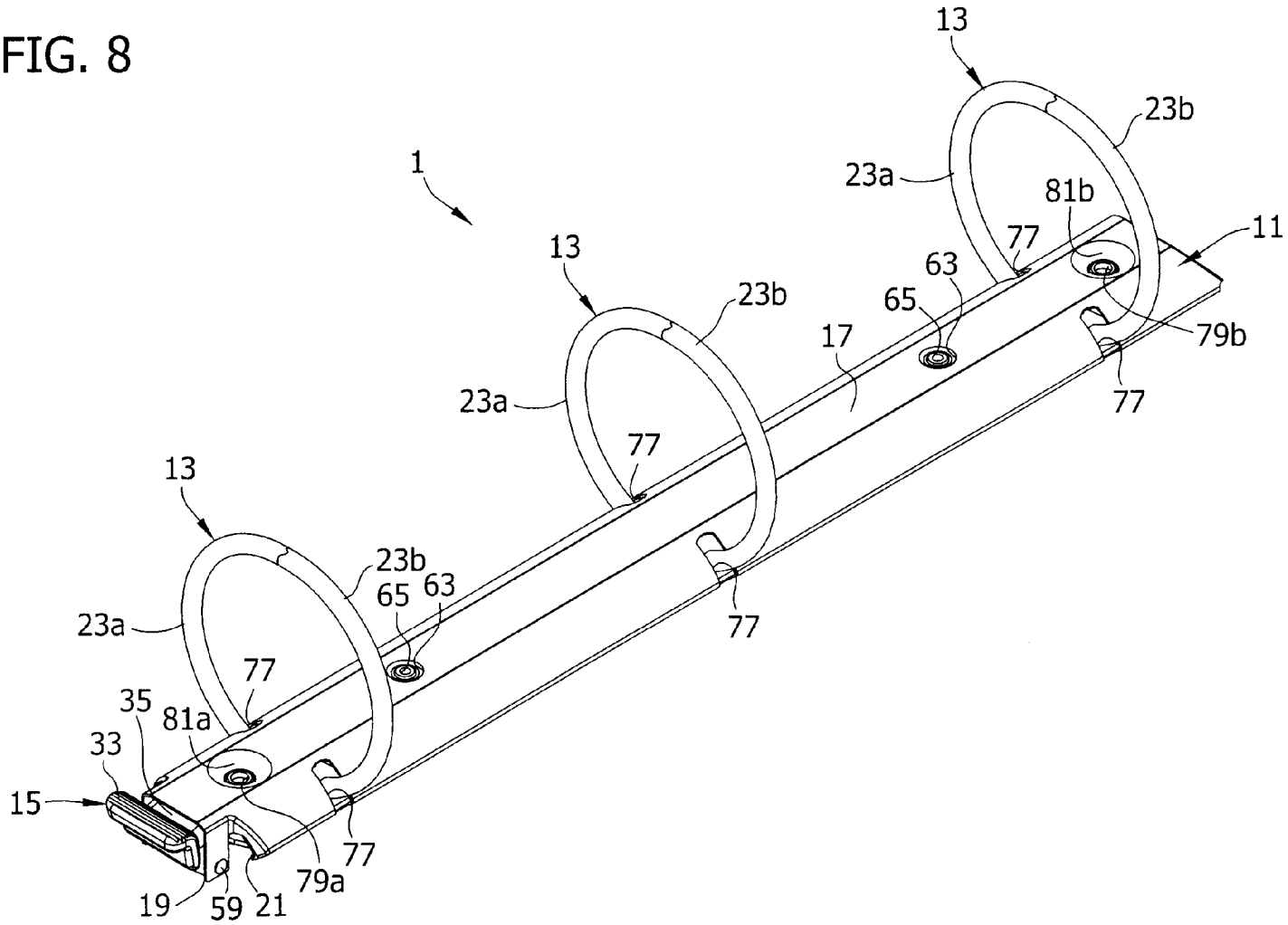
FIG. 8 is a top side perspective of the ring mechanism at a closed and unlocked position with the lever in a deformed position.

To unlock the ring mechanism 1 and open the ring members 23*a*, 23*b*, an operator applies force to the grip 33 of the lever 15 and pivots it counter-clockwise (as viewed in FIGS. 4, 6, and 7). As shown in FIGS. 8-10, the grip 33 and body 35 of the lever 15 move relative to the tongue 37, which is held stationery by the hinge plates 27*a*, 27*b* under the spring force of the housing 11. The intermediate connector 67 simultaneously moves with the body 35 and transfers the pivoting movement of the lever 15 around the mounting post 79*a* to the travel bar 45. The travel bar slides toward the lever 15 and moves the locking elements 49 into registration with the respective locking element openings 29*a-c* of the hinge plates 27*a*, 27*b*. The bridge 39 between the lever body 35 and lever tongue 37 flexes and tensions as the open channel 41 closes and the body moves into engagement with the tongue (FIG. 10). If the lever 15 is released before the hinge plates 27*a*, 27*b* pivot upward through their co-planar position (i.e., before the ring members 23*a*, 23*b* open), the tension in the bridge 39 will automatically recoil (and push) the grip 33 and body 35 back to the vertical position, moving the travel bar 45 and locking elements 49 to the locked position.

The lever channel 41, now closed, no longer shields the tongue 37 from the pivoting movement of the grip 33 and body 35. Continued opening movement of the lever 15 causes the body 35 to conjointly pivot the tongue 37. The lever bulb 43 causes the interconnected hinge plates 27*a*, 27*b* to pivot upward over the locking elements 49 at the locking element openings 29*a-c* and relative to the mounting post 79*a* at the mounting post opening 29*d*. Once the hinge plates 27*a*, 27*b* pass just through the co-planar position, the housing spring force pushes them upward, opening the ring members 23*a*, 23*b* (FIGS. 11-13). The lever 15 can be released. The tension in the bridge 39 recoils (and pushes) the grip 33 and body 35 away from the tongue 37, which is held stationary against the hinge plates 27*a*, 27*b* via the lever bulb 43 engaging the lower surfaces of the hinge plates. The channel 41 opens and the travel bar 45 moves slightly away from the lever 15. The lever is again relaxed, in a second relaxed position substantially identical to the first relaxed position (e.g., FIG. 3), and the locking elements 49 are at rest within the respective hinge plate openings 29*a-c* free of any forces tending to move them relative to the housing 11.

To close the ring members 23*a*, 23*b* and return the mechanism 1 to the locked position, an operator manually pushes the free ends 25*a*, 25*b* of the ring members together. The hinge plates 27*a*, 27*b* pivot downward, and rotate the lever tongue 37 clockwise (as viewed in FIGS. 11 and 13). The tongue 37 initially moves the grip 33 and body 35 to seat the locking elements 49 against tangs 83 at the edges of the locking element openings 29*a-c* of the hinge plates 27*a*, 27*b* (the tangs are ramped to assist the locking elements 49 in moving out of the openings). The tongue 37 then moves relative to the grip 33 and body 35, which are held stationary by the locking elements 49 against tangs 83 (FIG. 13). The lever channel 41 closes (and the lever bridge 39 flexes) allowing the hinge plates 27*a*, 27*b* to pivot to and through the co-planar position and past the narrow bottoms 53 of the locking elements 49. The angled sides 55*a* of the locking elements 49 allow the locking elements to move incrementally away from the lever 15 and out of the respective opening 29*a-c* as the hinge plates 27*a*, 27*b* move down. This allows the lever 15 to pivot slightly with the tongue 37 as the tongue channel 41 closes. The angled sides of the locking elements are not necessary for operation though.

Once the hinge plates 27*a*, 27*b* clear the bottoms 53 of the locking elements 49, the tongue 37 pushes the body 35 and grip 33 to the vertical position and the travel bar 45 and locking elements move to the locked position. The ring members 23*a*, 23*b* of the ring mechanism 1 could be closed by a modified lever capable of engaging the hinge plates 27*a*, 27*b* and pivoting them downward within the scope of the invention.

It should now be apparent that the flexibility of the lever bridge 39 allows the grip 33 and body 35 of the lever 15 to move relative to the tongue 37. This moves the lever 15 between the relaxed position (FIGS. 3-7 and 11-13) and a deformed (broadly, "reconfigured") position (FIGS. 8-10). The deformed position of the lever 15 is an unstable, intermediate position in which the bridge 39 is tensioned to always move the grip 33, body 35, and tongue 37 to the relaxed position (i.e., reconfigure the lever).

When the lever 15 pivots to open the ring members 23*a*, 23*b*, the travel bar 45 and locking elements 49 move immediately and prior to the tongue 37 and bulb 43 pivoting the hinge plates 27*a*, 27*b* upward. This lost motion caused by the open channel 41 allows the locking elements 49 to move into registration with the locking element openings 29*a-c* of the hinge plates 27*a*, 27*b* before the hinge plates pivot. They do not interfere with the desirable pivoting movement of the hinge plates 27*a*, 27*b*. After the locking elements 49 move into registration with the respective openings 29*a-c*, the channel 41 closes and the grip 33, body 35, and tongue 37 conjointly pivot to move the hinge plates 27*a*, 27*b* upward.

In addition when the ring members 23*a*, 23*b* are open and the lever 15 is relaxed, the locking elements 49 and travel bar 45 are free of forces tending to move them to the locked position. Thus, there is no tendency for the open ring members 23*a*, 23*b* to inadvertently close under the influence of the lever 15, locking elements 49, or travel bar 45 as an operator loads or removes pages from the ring members 23*a*, 23*b*.

Similarly when the ring members 23*a*, 23*b* are moved to the closed position, the lever channel 41 allows the hinge plates 27*a*, 27*b* to pivot downward over the locking elements 49 before the grip 33 and body 35 of the lever 15 push the travel bar 45 and locking elements 49 to the locked position. Here, the lost motion caused by the open channel 41 maintains a continuous engagement between the lever tongue 37 and the hinge plates 27*a*, 27*b* (via the lever bulb 43) without risk of the mechanism jamming in the open position (e.g., as may occur if the lever tongue is unable to move downward with the hinge plates because the locking elements 49 wedge against edges of the locking element openings 29*a-c* of the hinge plates, holding the hinge plates from further pivoting downward). The continuous engagement between the lever tongue 37 and the lower surfaces of the hinge plates 27*a*, 27*b* (via lever bulb 43) ensures that the body 35 and grip 33 of the lever 15 move fully to their vertical position when the hinge plates 27*a*, 27*b* are pivoted downward (and the ring members 23*a*, 23*b* are closed), moving the travel bar 45 and locking elements 49 fully to the locked position.

Thus, the ring binder mechanism 1 effectively retains loose-leaf pages when ring members 23*a*, 23*b* are closed, and readily prevents the closed ring members 23*a*, 23*b* from unintentionally opening. The lever 15 positions the travel bar 45 and its locking elements 49 in the locked position when the ring members 23*a*, 23*b* close, eliminating the need to manually move the lever 15 to positively lock the mechanism 1. The ring mechanism 1 incorporating the locking lever 15 requires no additional biasing components (e.g., springs) to perform the locking operation, and requires no specially formed parts to accommodate such biasing components.

Figure 14:
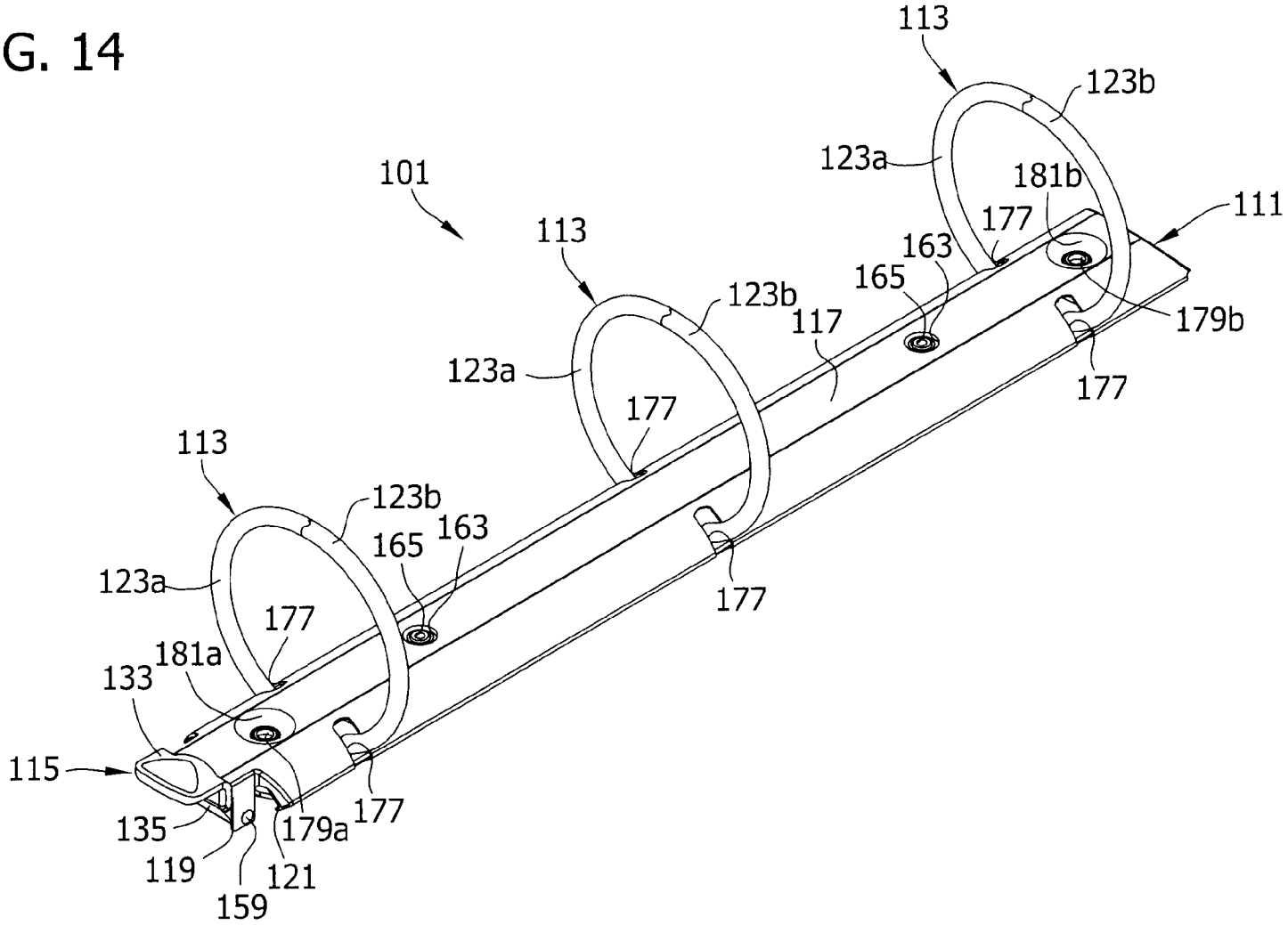
FIG. 14 is a top side perspective of a ring mechanism according to a second embodiment at the closed and locked position.
Figure 15:
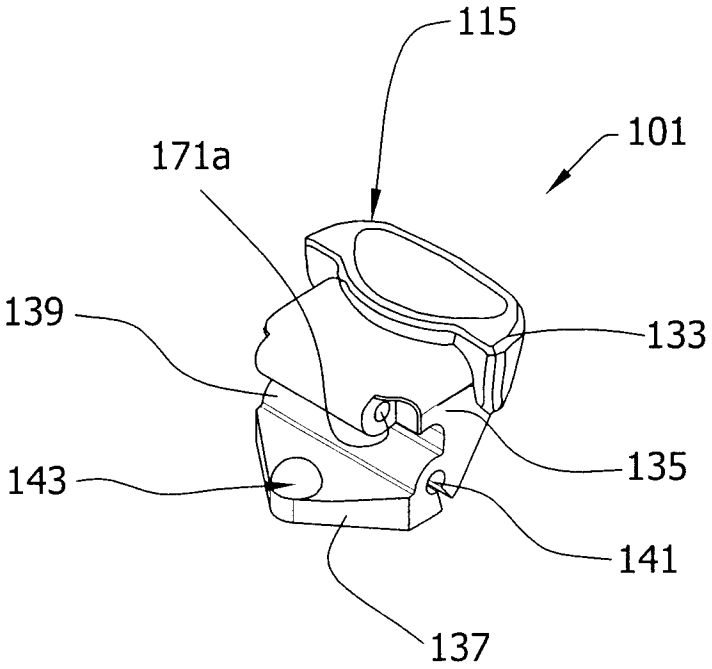
FIG. 15 is an enlarged top side perspective of a lever thereof.
Figure 16:
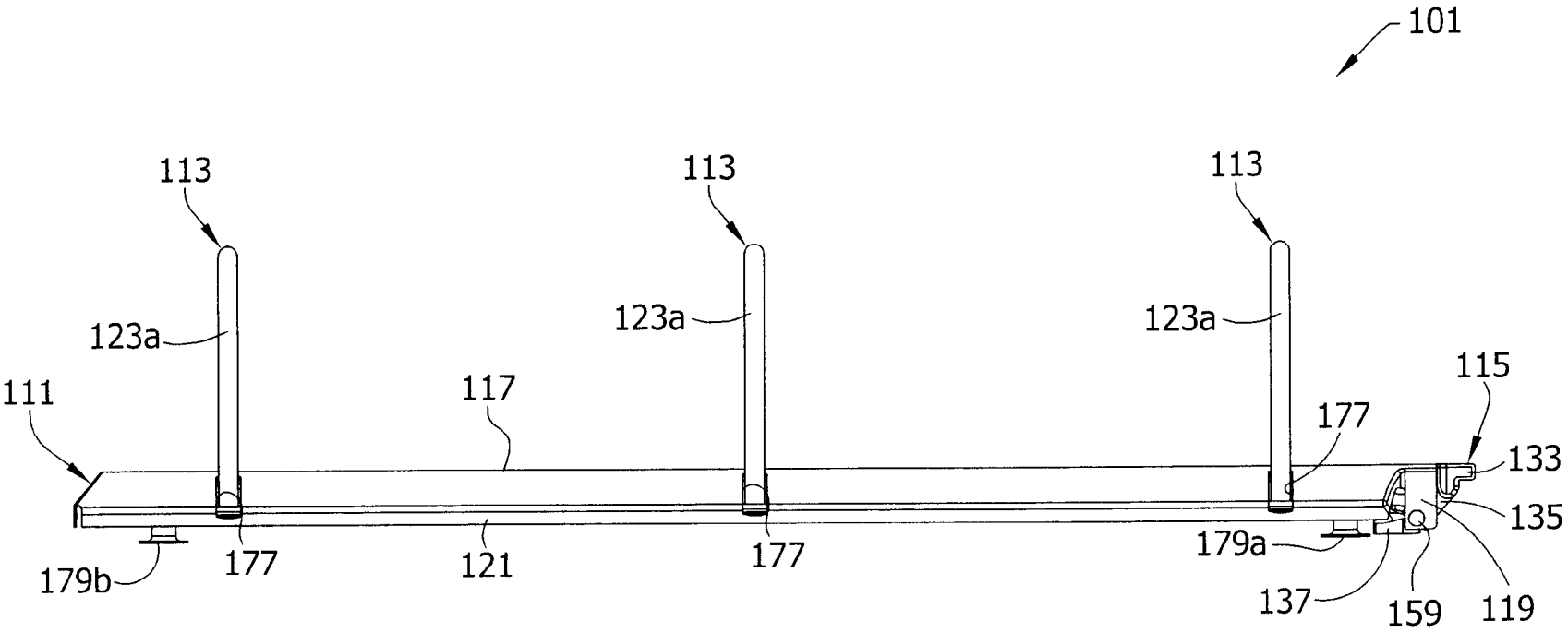
FIG. 16 is a side view of the ring mechanism.
Figure 17:
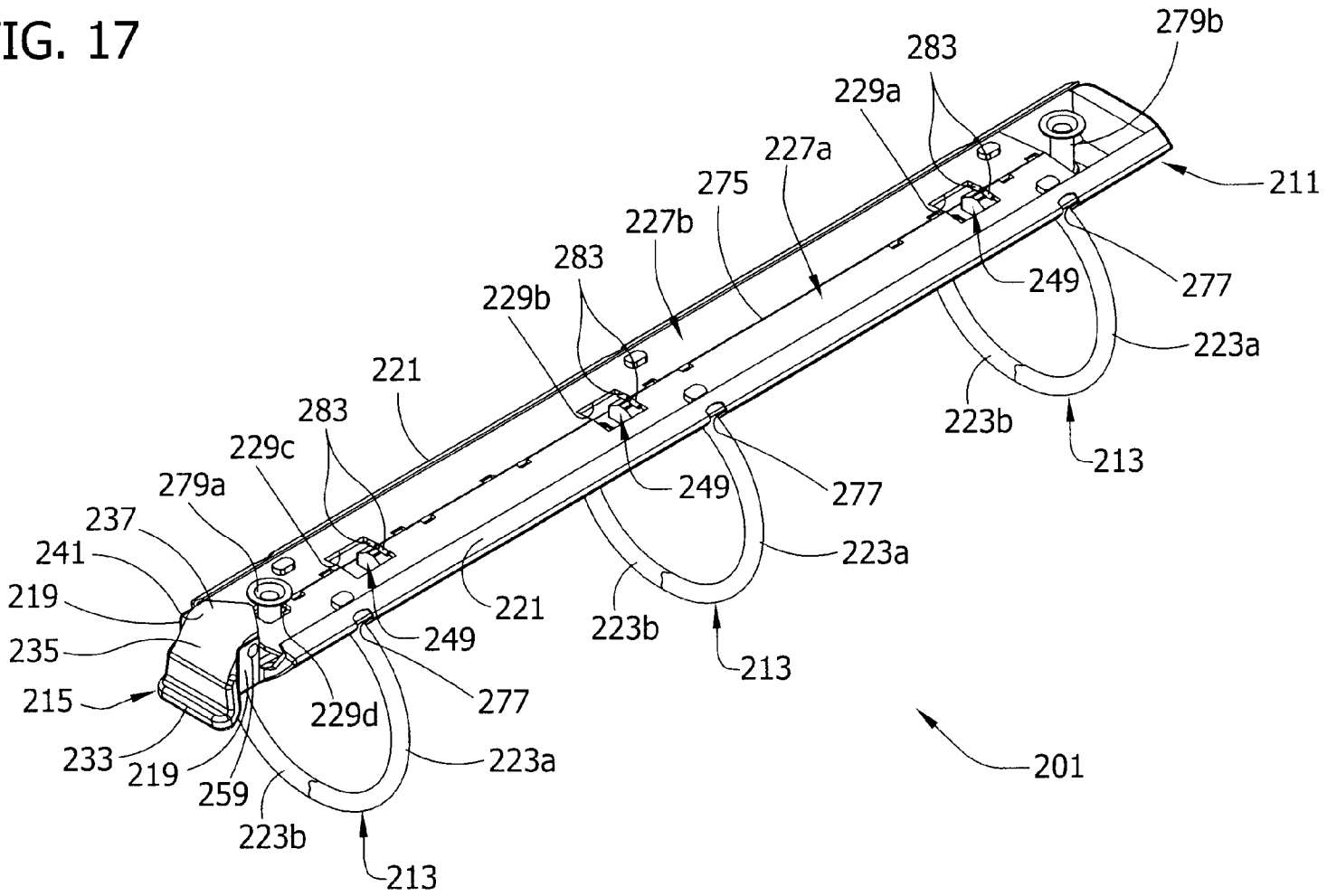
FIG. 17 is a bottom side perspective of a ring mechanism according to a third embodiment at the closed and locked position.
Figure 18:
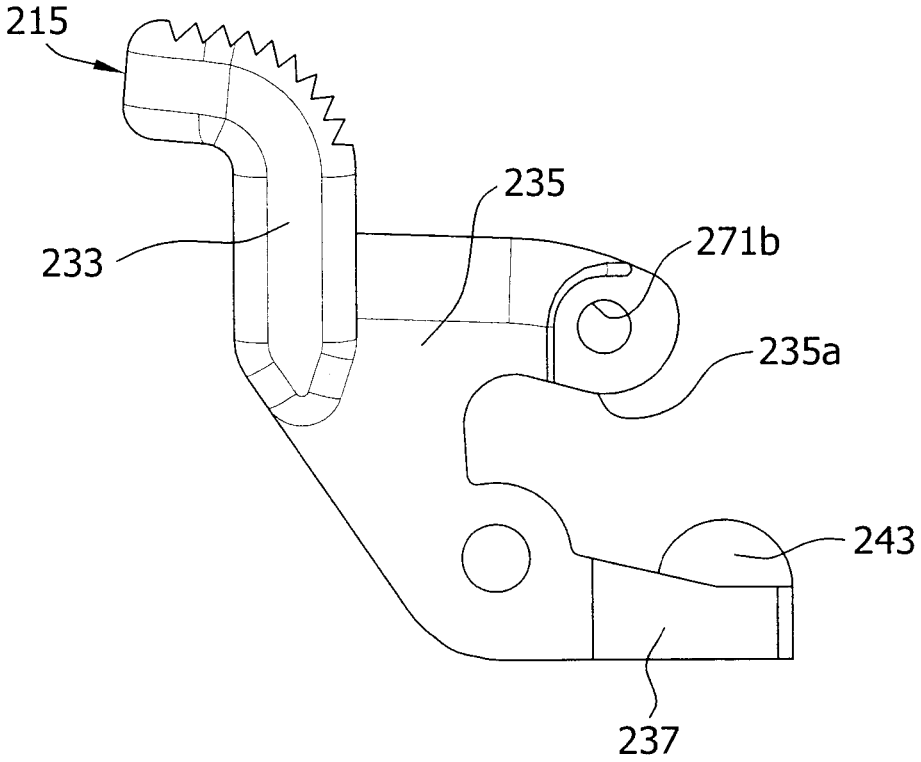
FIG. 18 is an enlarged side view of a lever thereof.

FIGS. 14-16 show a second embodiment of the ring binder mechanism generally at 101. The ring mechanism 101 is substantially the same as the ring mechanism 1 of the first embodiment previously described and illustrated in FIGS. 1-13, and parts of this ring mechanism 101 corresponding to parts of the prior ring mechanism 1 are designated by the same reference numerals, plus "100". In this ring mechanism 101, however, the lever 115 has a low profile in that it includes a substantially flat grip 133. The lever 115 mounts on the housing 111 (FIGS. 14 and 16) as previously described for the ring mechanism 1 of FIGS. 1-13, and the flat grip 133 is positioned in general alignment (i.e., is generally co-planar) with the plateau 117 of the housing. In all other aspects, including operation, the ring mechanism 101 is the same as the ring mechanism 1 of FIGS. 1-13.

FIGS. 17-21 show a third embodiment of the ring binder mechanism generally at 201. Parts of this ring mechanism corresponding to parts of the ring mechanism 1 of the first embodiment of FIGS. 1-13 are designated by the same reference numerals, plus "200". This mechanism 201 is substantially the same as the ring mechanism 1 of FIGS. 1-13, with the exception that the lever 215 is formed without a bridge and without a channel between the body 235 and the tongue 237. Other components of the ring mechanism 201, as well as assembly of the components, are substantially the same as those of the mechanism 1 of FIGS. 1-13.

Figure 19:
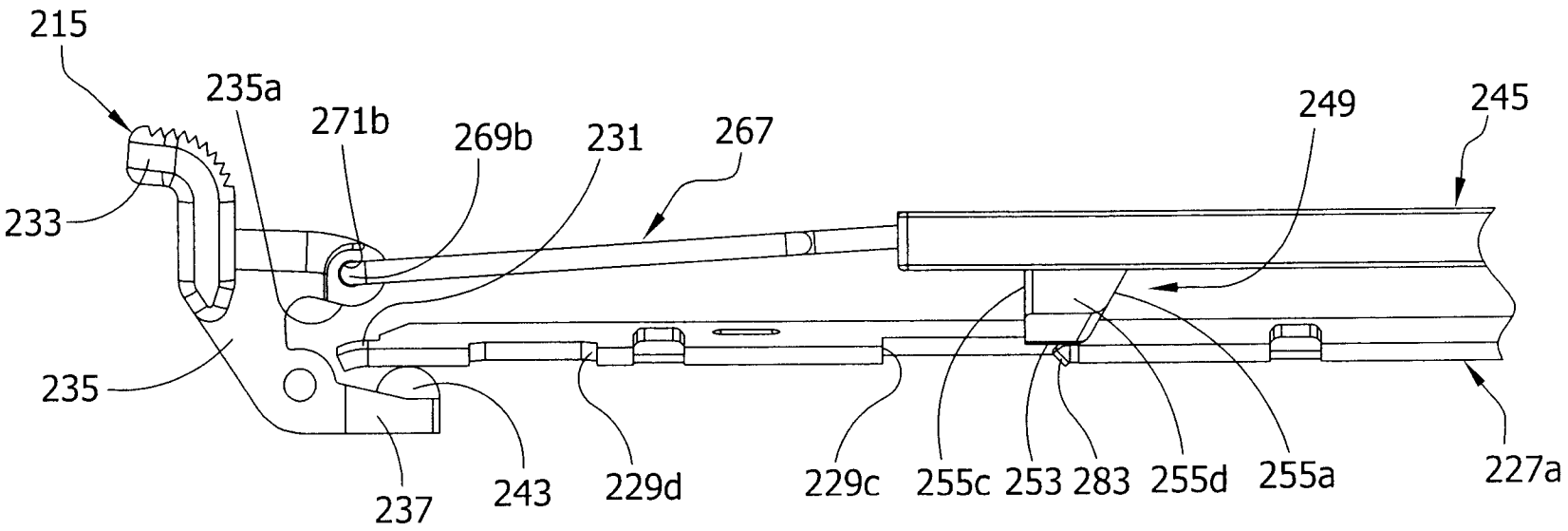
FIG. 19 is an enlarged fragmentary side view of the ring mechanism with a housing and ring members removed.
Figure 20:
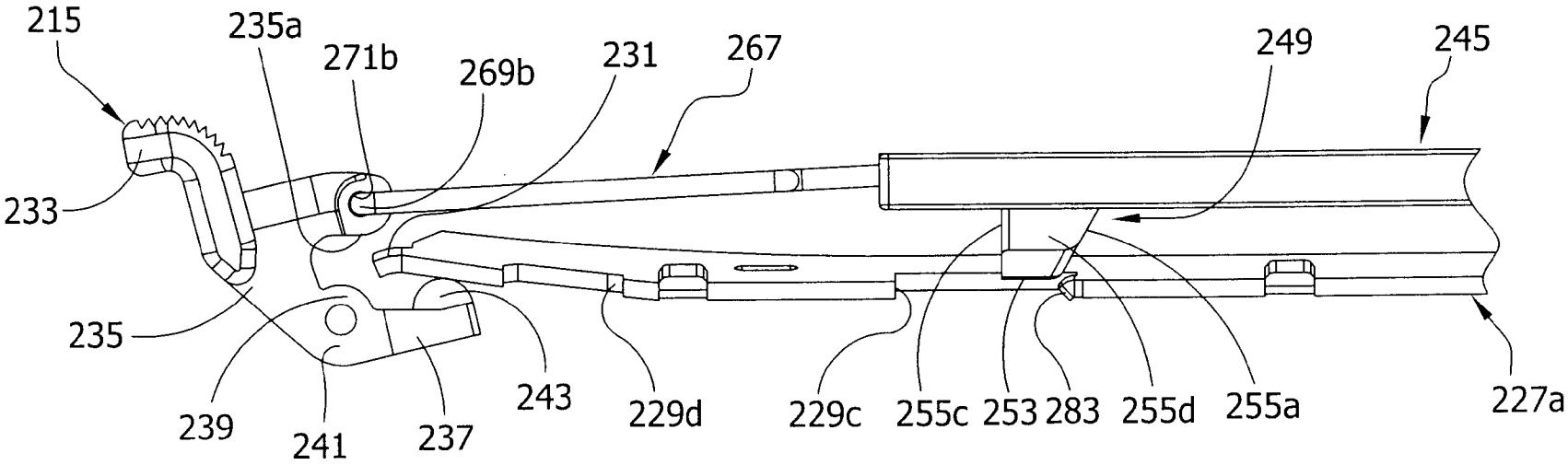
FIG. 20 is an enlarged fragmentary side view similar to FIG. 19 with the mechanism at the closed and unlocked position.
Figure 21:
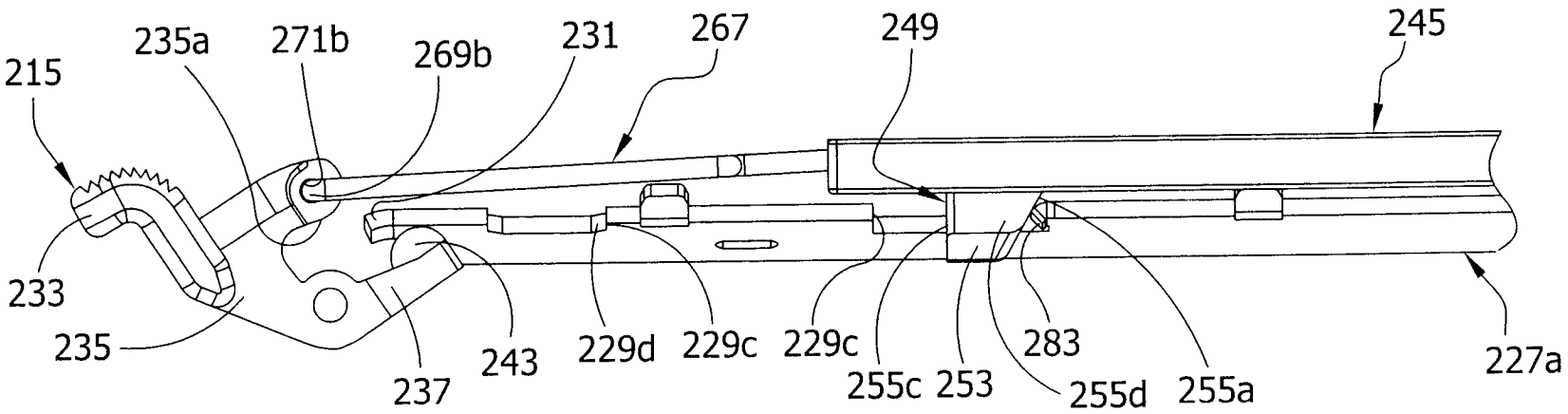
FIG. 21 is an enlarged fragmentary side view similar to FIG. 19 with the mechanism at the open position.

Operation of the ring mechanism 201 will be described with reference to the enlarged fragmentary views of FIGS. 19-21. In FIG. 19, the ring mechanism 201 is in the closed and locked position (similar to the closed position of the ring mechanism 1 of FIGS. 1-13). To unlock the ring mechanism 201 and open the ring members 223*a*, 223*b*, an operator pivots the lever 215 outward and downward (counter-clockwise as viewed in FIG. 19). The lever body 235 pulls the travel bar 245 and locking elements 249 toward the lever 215, while the lever bulb 243 simultaneously pushes upward on the hinge plates 227*a*, 227*b* (only one hinge plate 227*a* is shown). But the locking elements 249, still behind the hinge plates 227*a*, 227*b*, block their upward movement. So as the lever 215 continues to pivot, the lever bulb 243 flexes (and tensions) the hinge plates 227*a*, 227*b* adjacent the fingers 231 (FIG. 20). Once the locking elements 249 (only one is shown) move into registration with the locking element openings 229*a-c* (only opening 229*c* is shown) of the hinge plates 227*a*, 227*b*, the tensioned hinge plates immediately pivot upward, through the co-planar position (FIG. 21) to open the ring members 223*a*, 223*b* (the ring members are not shown). If the lever 215 is released before the hinge plates 227*a*, 227*b* pivot through the co-planar position, the tensioned hinge plates will push down on the lever bulb 243 and pivot the lever 215 back to the vertical position, moving the travel bar 245 and locking elements 249 to the locked position. The tension in the hinge plates 227*a*, 227*b* dissipates and the lever 215 can be released. The bulb 243 of the tongue 237 remains in engagement with the lower surfaces of the hinge plates 227*a*, 227*b*, and the spring force of the housing 211 holds the hinge plates hinged upward. The locking elements 249 are at rest within the respective hinge plate cutout openings 229*a-c* free of any forces tending to move them to the locked position.

As in the ring mechanism 1 of FIGS. 1-13, to close the ring members 223*a*, 223*b* of this mechanism 201 and return the mechanism to the locked position (FIG. 19), an operator manually pushes the free ends 225*a*, 225*b* of the ring members together. In this ring mechanism 201, the hinge plates 227*a*, 227*b* pivot downward and cause the lever bulb 243 and tongue 237 to rotate clockwise (as viewed in FIG. 21). The tongue 237 pushes the grip 233 and body 235 to seat the locking elements 249 against the tangs 281 at the edges of the locking element openings 229*a-c* of the hinge plates 227*a*, 227*b* (this engagement is not necessary for operation). The locking elements 249 instantaneously resist movement of the lever 215, and thus downward movement of the hinge plates 227*a*, 227*b*, causing the hinge plates 227*a*, 227*b* to slightly flex adjacent their fingers 231. The hinge plates 227*a*, 227*b* bend down while the lever 215 and finger 231 remain relatively stationary. The angled sides 255*a* of the locking elements 249 allow the locking elements to move small amounts away from the lever 215 as the hinge plates 227*a*, 227*b* bend, allowing the lever to pivot slightly. Once the hinge plates 227*a*, 227*b* clear the narrow bottoms 253 of the locking elements 249, the tension in the flexed hinge plates immediately pivots the lever 215 to its vertical position, pushing the travel bar 245 and locking elements 249 to the locked position.

In this ring mechanism 201, the unique cooperation between the lever 215, the hinge plates 227*a*, 227*b*, and the locking elements 249 allows the mechanism to operate between the closed and locked position and the open position. When opening the ring members 223*a*, 223*b*, the hinge plates 227*a*, 227*b* briefly flex upward to allow the lever 215 to pivot to move the locking elements 249 into registration with the locking element openings 229*a-c* of the hinge plates. The lever 215, together with the tension from the flexed hinge plates 227*a*, 227*b* and the spring force of the housing 211, then pivot the hinge plates over the locking elements 249 to open the ring members 223*a*, 223*b*. When closing the ring members 223*a*, 223*b*, the hinge plates 227*a*, 227*b* again flex to allow the plates to pivot downward over the locking elements 249 (the angled sides 255*a* of the locking elements 249 also aid in this operation, but are not necessary for this operation).

Components of ring binder mechanisms of the embodiments described and illustrated herein are made of a suitable rigid material, such as a metal (e.g. steel). But mechanisms having components made of a nonmetallic material, specifically including a plastic, do not depart from the scope of this invention.

When introducing elements of the ring binder mechanisms herein, the articles "a", "an", "the" and "said" are intended to mean that there are one or more of the elements. The terms "comprising", "including" and "having" are intended to be inclusive and mean that there may be additional elements other than the listed elements. Moreover, the use of "up" and "down" and variations of these terms is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring mechanism for holding loose-leaf pages, the mechanism comprising:

a housing having a central portion and sides extending downward from the central portion;

rings for holding the loose-leaf pages, each ring including a first ring member and a second ring member, at least one of the ring members being movable relative to the housing and the other ring member between a closed position and an open position, in the closed position the two ring members form a substantially continuous, closed loop for allowing loose-leaf pages retained by the rings to be moved along the rings from one ring member to the other, and in the open position the two ring members form a discontinuous, open loop for adding or removing loose-leaf pages from the rings;

first and second hinge plates supported in the housing for pivoting motion relative to the housing, said one ring member being mounted on the first hinge plate; and a generally flat rectangular travel bar carrying a plurality of wedges that move the hinge plates to open and close the rings, the travel bar being secured to the housing in a manner that vertically supports the travel bar within the housing and limits vertical movement of the travel bar within the housing while allowing translation of the travel bar lengthwise of the housing between a locked position in which pivoting motion of the hinge plates to open the rings is blocked and an open position in which the rings are open, the travel bar being biased to remain in the locked position when it is in the locked position, the travel bar being free of forces tending to move the travel bar to the locked position when the travel bar is in the open position.

2. A ring mechanism as set forth in claim 1 in combination with a notebook, the ring mechanism being secured to the notebook so the sides of the housing are adjacent the notebook.

3. A ring mechanism as set forth in claim 1 wherein the travel bar has a mounting groove, the mechanism further comprising a connector and a biasing member positioned to bias the travel bar to the locked position when the travel bar is in the locked position, the connector connecting the travel bar to the biasing member, the connector being received in the mounting groove of the travel bar.

4. A ring mechanism as set forth in claim 3 wherein the connector comprises an elongate wire connector.

5. A ring mechanism as set forth in claim 1 wherein the first and second hinge plates have longitudinal outer margins that pivotally engage the sides of the housing.

6. A ring mechanism as set forth in claim 1 wherein the travel bar is secured to the housing by rivets.

7. A ring mechanism as set forth in claim 1 wherein the travel bar extends longitudinally in a space between the housing and the hinge plates.

8. A ring mechanism as set forth in claim 1 wherein the wedges are formed as one-piece with the travel bar.

9. A ring mechanism for holding loose-leaf pages, the mechanism comprising:

a housing having a central portion and sides extending downward from the central portion;

rings for holding the loose-leaf pages, each ring including a first ring member and a second ring member, at least one of the ring members being movable relative to the housing and the other ring member between a closed position and an open position, in the closed position the two ring members form a substantially continuous, closed loop for allowing loose-leaf pages retained by the rings to be moved along the rings from one ring member to the other, and in the open position the two ring members form a discontinuous, open loop for adding or removing loose-leaf pages from the rings;

first and second hinge plates supported in the housing for pivoting motion relative to the housing, said one ring member being mounted on the first hinge plate; and a generally flat rectangular travel bar carrying a plurality of locking elements, the travel bar being secured to the housing in a manner that vertically supports the travel bar within the housing and limits vertical movement of the travel bar within the housing while allowing translation of the travel bar lengthwise of the housing between a locked position in which pivoting motion of the hinge plates to open the rings is blocked by the locking elements and an open position in which the rings are open, the travel bar being biased to remain in the locked position when it is in the locked position, the travel bar being free of forces tending to move the travel bar to the locked position when the travel bar is in the open position.

10. A ring mechanism as set forth in claim 9 in combination with a notebook, the ring mechanism being secured to the notebook so the sides of the housing are adjacent the notebook.

11. A ring mechanism as set forth in claim 9 wherein the travel bar has a mounting groove, the mechanism further comprising a connector and a biasing member positioned to bias the travel bar to the locked position when the travel bar is in the locked position, the connector connecting the travel bar to the biasing member, the connector being received in the mounting groove of the travel bar.

12. A ring mechanism as set forth in claim 11 wherein the connector comprises an elongate wire.

13. A ring mechanism as set forth in claim 9 wherein the first and second hinge plates have longitudinal outer margins that pivotally engage the sides of the housing.

14. A ring mechanism as set forth in claim 9 wherein the travel bar is secured to the housing by rivets.

15. A ring mechanism as set forth in claim 9 wherein the travel bar extends longitudinally in a space between the housing and the hinge plates.

16. A ring mechanism as set forth in claim 9 wherein the travel bar has three locking elements spaced longitudinally from one another.

17. A ring mechanism as set forth in claim 16 wherein the locking elements have an angled surface positioned to engage the hinge plates during movement of the rings from the open position to the closed position.

18. A ring mechanism as set forth in claim 9 wherein the locking elements are formed as one-piece with the travel bar.

19. A ring mechanism for holding loose-leaf pages, the mechanism comprising:

a housing having a central portion and sides extending downward from the central portion;

rings for holding the loose-leaf pages, each ring including a first ring member and a second ring member, at least one of the ring members being movable relative to the housing and the other ring member between a closed position and an open position, in the closed position the two ring members form a substantially continuous, closed loop for allowing loose-leaf pages retained by the rings to be moved along the rings from one ring member to the other, and in the open position the two ring members form a discontinuous, open loop for adding or removing loose-leaf pages from the rings;

first and second hinge plates supported in the housing for pivoting motion relative to the housing, said one ring member being mounted on the first hinge plate;

a generally flat rectangular travel bar, the travel bar being secured to the housing in a manner that vertically supports the travel bar within the housing and limits vertical movement of the travel bar within the housing while allowing translation of the travel bar lengthwise of the housing between a locked position in which pivoting motion of the hinge plates to open the rings is blocked and an open position in which the rings are open, wherein the travel bar has a mounting groove;

a biasing member biasing the travel bar to the locked position when the travel bar is in the locked position; and a connector connecting the travel bar to the biasing member, the connector being received in the mounting groove of the travel bar.

20. A ring mechanism as set forth in claim 19 wherein the connector comprises an elongate wire.

* * * * *